US010319216B2

(12) United States Patent
Arsenault et al.

(10) Patent No.: US 10,319,216 B2
(45) **Date of Patent: *Jun. 11, 2019**

(54) SYSTEMS FOR END USER PREMISE EVENT NOTIFICATION

(71) Applicant: BCE INC., Verdun (CA)

(72) Inventors: Jonathan Allan Arsenault, Orleans (CA); David William Clark, Carp (CA)

(73) Assignee: BCE Inc., Verdun (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/876,656

(22) Filed: Jan. 22, 2018

(65) Prior Publication Data

US 2018/0144611 A1 May 24, 2018

Related U.S. Application Data

(63) Continuation of application No. 13/142,249, filed as application No. PCT/CA2008/002266 on Dec. 24, 2008, now Pat. No. 9,875,642.

(51) Int. Cl.

| | |
|---|---|
| ***G08B 25/10*** | (2006.01) |
| ***G08B 25/00*** | (2006.01) |
| ***G08B 29/02*** | (2006.01) |

(52) U.S. Cl.
CPC ..... *G08B 25/10* (2013.01); *G08B 25/009* (2013.01); *G08B 29/02* (2013.01)

(58) Field of Classification Search
CPC ..... G08B 25/10; G08B 25/009; G08B 29/02
See application file for complete search history.

*Primary Examiner* — Habte Mered
(74) *Attorney, Agent, or Firm* — Gowling WLG (Canada) LLP

(57) ABSTRACT

Methods and systems to notify a party at a given premise when a particular event, such as a fire, an intrusion, an emergency or another event, occurs at another premise. One method comprises: obtaining an indication of a particular event at a first end-user premise, the first end-user premise including first end-user equipment connected to a communications network via a first communication link; establishing a wireless communication link between the first end-user equipment and second end-user equipment at a second end-user premise, the second end-user equipment being connected to the communications network via a second communication link; and causing the first end-user equipment to transmit information to the second end-user equipment via the wireless communication link to instruct the second end-user equipment to issue a notification concerning the particular event. Also provided are apparatus and computer-readable media containing a program element executable by a computing system to perform such a method.

44 Claims, 8 Drawing Sheets

SYSTEMS FOR END USER PREMISE EVENT NOTIFICATION

FIELD OF THE INVENTION

The invention relates generally to telecommunications and, more particularly, to methods and systems for notifying a party at an end-user premise when a particular event occurs at another end-user premise.

BACKGROUND

When an undesirable event such as a fire, an intrusion or a medical emergency occurs at a given premise (e.g., a residence or other building), phones, computers, alarm system devices and/or other pieces of equipment at the given premise can often be used to effect communications to report or otherwise deal with the undesirable event.

For example, in cases where a detector (e.g., a smoke detector, a glass break detector, etc.) of an alarm system at a given premise detects a fire or an intrusion, the alarm system may, in addition to emitting an audible alarm signal at the given premise, report the fire or intrusion to an alarm monitoring central. As another example, in cases where someone at a given premise experiences a medical emergency (e.g., a heart attack, a poisoning or some other acute injury or illness), a telephone at the given premise may be used to call emergency medical services.

Although this communication capability can be very useful, in some situations, it may be desirable and/or more appropriate to notify individuals at other premises of an undesirable event at a given premise. For example, in cases where a fire breaks out at a given premise, it may sometimes be desirable to notify individuals at neighboring premises such that they may proceed to evacuate in view of potential propagation of the fire. As another example, in cases where a person at a given premise experiences a medical emergency, it may be desirable to notify people at neighboring premises such that they can perhaps go and help the person in need until emergency medical personnel arrives on scene.

Accordingly, there exists a need for solutions to notify a party at a given premise when a particular event occurs at another premise.

SUMMARY OF THE INVENTION

According to a first broad aspect, the invention provides a method for notifying a party of a particular event at a first end-user premise. The method comprises: obtaining an indication of the particular event; establishing a wireless communication link between end-user equipment at the first end-user premise and a communication apparatus at a second end-user premise, the communication apparatus at the second end-user premise being connected to at least one end-user device at the second end-user premise; and causing the end-user equipment at the first end-user premise to transmit information to the communication apparatus at the second end-user premise via the wireless communication link such that, upon receiving the information, the communication apparatus at the second end-user premise directs the at least one end-user device at the second end-user premise to issue a notification concerning the particular event.

According to a second broad aspect, the invention provides apparatus for notifying a party of a particular event at a first end-user premise. The apparatus comprises a processing entity configured to obtain an indication of the particular event. The apparatus also comprises a notification entity configured to: establish a wireless communication link between end-user equipment at the first end-user premise and a communication apparatus at a second end-user premise, the communication apparatus at the second end-user premise being connected to at least one end-user device at the second end-user premise; and cause the end-user equipment at the first end-user premise to transmit information to the communication apparatus at the second end-user premise via the wireless communication link such that, upon receiving the information, the communication apparatus at the second end-user premise directs the at least one end-user device at the second end-user premise to issue a notification concerning the particular event.

According to a third broad aspect, the invention provides computer-readable media containing a program element executable by a computing system to perform a method for notifying a party of a particular event at a first end-user premise. The program element comprises: first program code for causing the computing system to obtain an indication of the particular event; second program code for causing the computing system to establish a wireless communication link between end-user equipment at the first end-user premise and a communication apparatus at a second end-user premise, the communication apparatus at the second end-user premise being connected to at least one end-user device at the second end-user premise; and third program code for causing the computing system to cause the end-user equipment at the first end-user premise to transmit information to the communication apparatus at the second end-user premise via the wireless communication link such that, upon receiving the information, the communication apparatus at the second end-user premise directs the at least one end-user device at the second end-user premise to issue a notification concerning the particular event.

According to a fourth broad aspect, the invention provides a method for notifying a party of a particular event at a first end-user premise, the party being located at a second end-user premise, the first end-user premise including a first communication apparatus connected to a communications network via a first communication link, the first communication apparatus controlling data routing within a first local network at the first end-user premise, the second end-user premise including a second communication apparatus connected to the communications network via a second communication link, the second communication apparatus controlling data routing within a second local network at the second end-user premise. The method is implemented by the first communication apparatus and comprises: obtaining an indication of the particular event based on information transmitted by an end-user device within the first local network; wirelessly joining the second local network to establish a wireless communication link between the first communication apparatus and the second communication apparatus; and transmitting information to the second communication apparatus via the wireless communication link such that, upon receiving the information transmitted via the wireless communication link, the second communication apparatus directs at least one end-user device within the second local network to issue a notification concerning the particular event.

According to a fifth broad aspect, the invention provides apparatus for notifying a party of a particular event at a first end-user premise, the party being located at a second end-user premise, the apparatus being located at the first end-user premise and being connected to a communications network via a first communication link, the apparatus controlling data routing within a first local network at the first end-user premise, the second end-user premise including a communication apparatus connected to the communications network via a second communication link, the communication apparatus controlling data routing within a second local network at the second end-user premise. The apparatus comprises a processing entity configured to obtain an indication of the particular event based on information transmitted by an end-user device within the first local network. The apparatus also comprises a notification entity configured to: cause the apparatus to wirelessly join the second local network to establish a wireless communication link between the apparatus and the communication apparatus; and transmit information to the communication apparatus via the wireless communication link such that, upon receiving the information transmitted via the wireless communication link, the communication apparatus directs at least one end-user device within the second local network to issue a notification concerning the particular event.

According to a sixth broad aspect, the invention provides computer-readable media containing a program element executable by a computing system to perform a method for notifying a party of a particular event at a first end-user premise, the party being located at a second end-user premise, the first end-user premise including a first communication apparatus connected to a communications network via a first communication link, the first communication apparatus controlling data routing within a first local network at the first end-user premise, the second end-user premise including a second communication apparatus connected to the communications network via a second communication link, the second communication apparatus controlling data routing within a second local network at the second end-user premise, the computing system being implemented by the first communication apparatus. The program element comprises: first program code for causing the computing system to obtain an indication of the particular event based on information transmitted by an end-user device within the first local network; second program code for causing the computing system to cause the first communication apparatus to wirelessly join the second local network to establish a wireless communication link between the first communication apparatus and the second communication apparatus; and third program code for causing the computing system to transmit information to the second communication apparatus via the wireless communication link such that, upon receiving the information transmitted via the wireless communication link, the second communication apparatus directs at least one end-user device within the second local network to issue a notification concerning the particular event.

According to a seventh broad aspect, the invention provides a method for notifying a party of a particular event at a first end-user premise, the first end-user premise including first end-user equipment connected to a communications network via a first communication link. The method comprises: obtaining an indication of the particular event; establishing a wireless communication link between the first end-user equipment and second end-user equipment at a second end-user premise, the second end-user equipment being connected to the communications network via a second communication link; and causing the first end-user equipment to transmit information to the second end-user equipment via the wireless communication link to instruct the second end-user equipment to issue a notification concerning the particular event.

According to an eighth broad aspect, the invention provides apparatus for notifying a party of a particular event at a first end-user premise, the first end-user premise including first end-user equipment connected to a communications network via a first communication link. The apparatus comprises a processing entity configured to obtain an indication of the particular event. The apparatus also comprises a notification entity configured to: establish a wireless communication link between the first end-user equipment and second end-user equipment at a second end-user premise, the second end-user equipment being connected to the communications network via a second communication link; and cause the first end-user equipment to transmit information to the second end-user equipment via the wireless communication link to instruct the second end-user equipment to issue a notification concerning the particular event.

According to a ninth broad aspect, the invention provides computer-readable media containing a program element executable by a computing system to perform a method for notifying a party of a particular event at a first end-user premise, the first end-user premise including first end-user equipment connected to a communications network via a first communication link. The program element comprises: first program code for causing the computing system to obtain an indication of the particular event; second program code for causing the computing system to establish a wireless communication link between the first end-user equipment and second end-user equipment at a second end-user premise, the second end-user equipment being connected to the communications network via a second communication link; and third program code for causing the computing system to cause the first end-user equipment to transmit information to the second end-user equipment via the wireless communication link to instruct the second end-user equipment to issue a notification concerning the particular event.

These and other aspects of the invention will become apparent to those of ordinary skill in the art upon review of the following description of example embodiments of the invention in conjunction with the accompanying drawings.

BRIEF DESCRIPTION OF THE DRAWINGS

A detailed description of certain embodiments of the invention is provided herein below, by way of example only, with reference to the accompanying drawings, in which.

It is to be expressly understood that the description and drawings are only for the purpose of illustration of example embodiments of the invention and are an aid for understanding. They are not intended to be a definition of the limits of the invention.

DETAILED DESCRIPTION OF EMBODIMENTS

Figure 1:
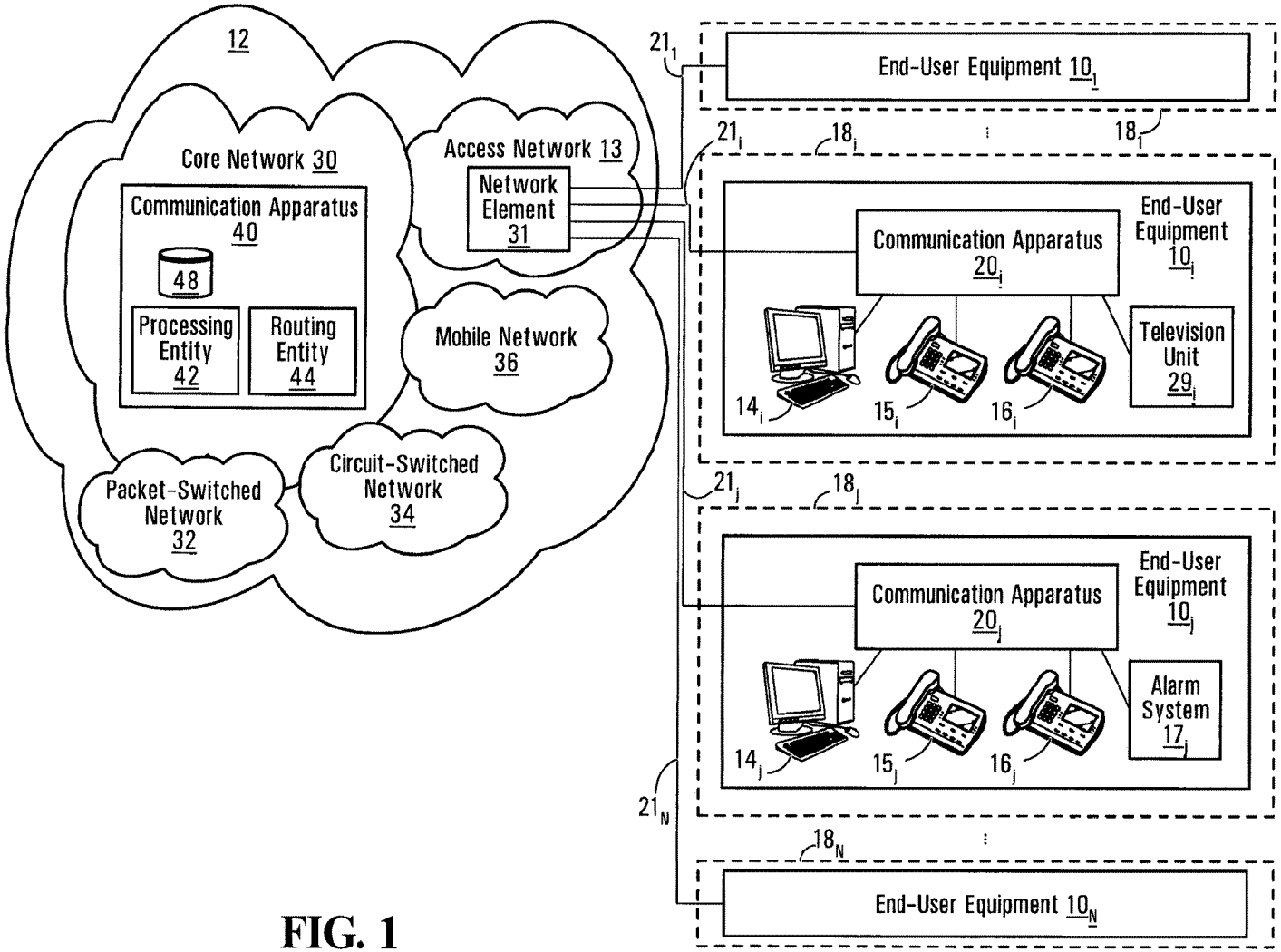
FIG. 1 shows an example of an architecture comprising a communications network allowing end-user equipment located at respective end-user premises to effect various communications, in accordance with an embodiment of the invention.

FIG. 1 shows an example of an architecture comprising a communications network 12 allowing end-user equipment $\mathbf{10}_1$-$\mathbf{10}_N$ located at respective end-user premises $\mathbf{18}_1$-$\mathbf{18}_N$ to effect various communications, including telephone calls, accesses to data network sites (e.g., websites), alarm system communications, and/or other communications (e.g., television signals), in accordance with an embodiment of the invention. Each of the end-user premises $\mathbf{18}_1$-$\mathbf{18}_N$ may be a residence (such as a house or an apartment) or other building (or a part thereof).

The end-user equipment $\mathbf{10}_x$ ($1 \leq x \leq N$) at the end-user premise $\mathbf{18}_x$ is connected to the communications network 12 via a respective one of a plurality of communication links $\mathbf{21}_1$-$\mathbf{21}_N$ that reach corresponding ones of the end-user premises $\mathbf{18}_1$-$\mathbf{18}_N$. In this embodiment, the communication links $\mathbf{21}_1$-$\mathbf{21}_N$ are part of an access network 13 that is provided by a service provider providing communication services to the end-user premises $\mathbf{18}_1$-$\mathbf{18}_N$. The access network 13 leads to a core network 30 provided by the service provider to enable the end-user equipment $\mathbf{10}_1$-$\mathbf{10}_N$ at the end-user premises $\mathbf{18}_1$-$\mathbf{18}_N$ to effect communications over various networks of the communications network 12, including a packet-switched network 32 (e.g., the Internet), a circuit-switched network 34 (e.g., the Public Switched Telephone Network (PSTN)) and a mobile network 36 (e.g., a Global System for Mobile Communications (GSM) network or other cellular network).

More particularly, in this embodiment, each of the communication links $\mathbf{21}_1$-$\mathbf{21}_N$ comprises a metallic twisted-pair cable (e.g., a copper twisted-pair cable) or a coaxial cable that is connected to a network element 31 of the access network 13. Also, in this embodiment, the access network 13 is based on a fiber-to-the-node or -neighborhood (FTTN) infrastructure such that the network element 31 comprises a FTTN platform (e.g., an Alcatel 7330 Intelligent Services Access Manager (ISAM) Fiber to the Node (FTTN) platform) which, in addition to being connected to the communication links $\mathbf{21}_1$-$\mathbf{21}_N$, is connected to optical fiber cabling of the access network 13. The optical fiber cabling is connected to other components of the access network 13 (e.g., one or more routers or switches, an optical Ethernet network, etc.) that interface with the core network 30.

The access network 13 and the communication links $\mathbf{21}_1$-$\mathbf{21}_N$ may be implemented in various other ways in other embodiments. For example, in some embodiments, the access network 13 may be based on a fiber-to-the-curb (FTTC) infrastructure and the network element 31 may be a FTTC platform. In other embodiments, the network element 31 may be omitted depending on the nature of the access network 13. For instance, in some embodiments, the access network 13 may be based on a fiber-to-the-premises (FTTP) infrastructure (e.g., fiber-to-the-building (FTTB) or fiber-to-the-house (FTTH) infrastructures) in which case the communication links $\mathbf{21}_1$-$\mathbf{21}_N$ may comprise optical fiber cables leading to optical network terminals (ONTs) that may be part of the end-user equipment $\mathbf{10}_1$-$\mathbf{10}_N$ at the end-user premises $\mathbf{18}_1$-$\mathbf{18}_N$. In yet other embodiments, the communication links $\mathbf{21}_1$-$\mathbf{21}_N$ may comprise a wireless link portion (e.g., a WiMAX link, a satellite-based link).

The core network 30 comprises a communication apparatus 40 configured to perform various operations when a communication, such as a telephone call, an access to a data network site or an alarm system communication, is originated by, destined for, in progress at certain end-user equipment (such as any of the end-user equipment $\mathbf{10}_1$-$\mathbf{10}_N$). The communication apparatus 40 comprises suitable hardware, firmware, software or a combination thereof for implementing a plurality of functional entities, including a processing entity 42, a routing entity 44 and a database 48.

The processing entity 42 implements a processing logic to process communications originated by, destined for, or in progress at end-user equipment (such as any of the end-user equipment $\mathbf{10}_1$-$\mathbf{10}_N$). The processing logic may be defined by a sequence of decisions to be taken with respect to a given communication, which may lead to one or more actions being performed based on those decisions. Each decision taken with respect to the given communication may be based on one or more factors. One example of such a factor is an origin of the given communication which, for instance, may be specified by: a telephone number, an Internet Protocol (IP) address, a Uniform Resource Identifier (URI) (e.g., a Session Initiation Protocol (SIP) URI), and/or another identifier identifying a device that originated the given communication; a name or other identifier of a party that originated the given communication; a time at which the given communication was originated (e.g., a day, hour, minute, etc.); and/or a location (e.g., a civic address) where the given communication was originated. Another example of such a factor is a destination of the given communication which, for instance, may be specified by: a telephone number, an IP address, a URI (e.g., a SIP URI), and/or another identifier identifying a device for which the given communication is destined; a name or other identifier of a party for which the given communication is destined; and/or a location (e.g., a civic address) for which the given communication is destined. In some cases, a factor on which may be based a decision to be taken with respect to the given communication may also be defined in terms of certain information included in the database 48 that may be accessed by the processing entity 42 (e.g., where the given communication is a telephone call, certain information in the database 48 on how to process calls involving a party having originated the telephone call or for which the telephone call is destined may be used by the processing entity 42).

Figure 2:
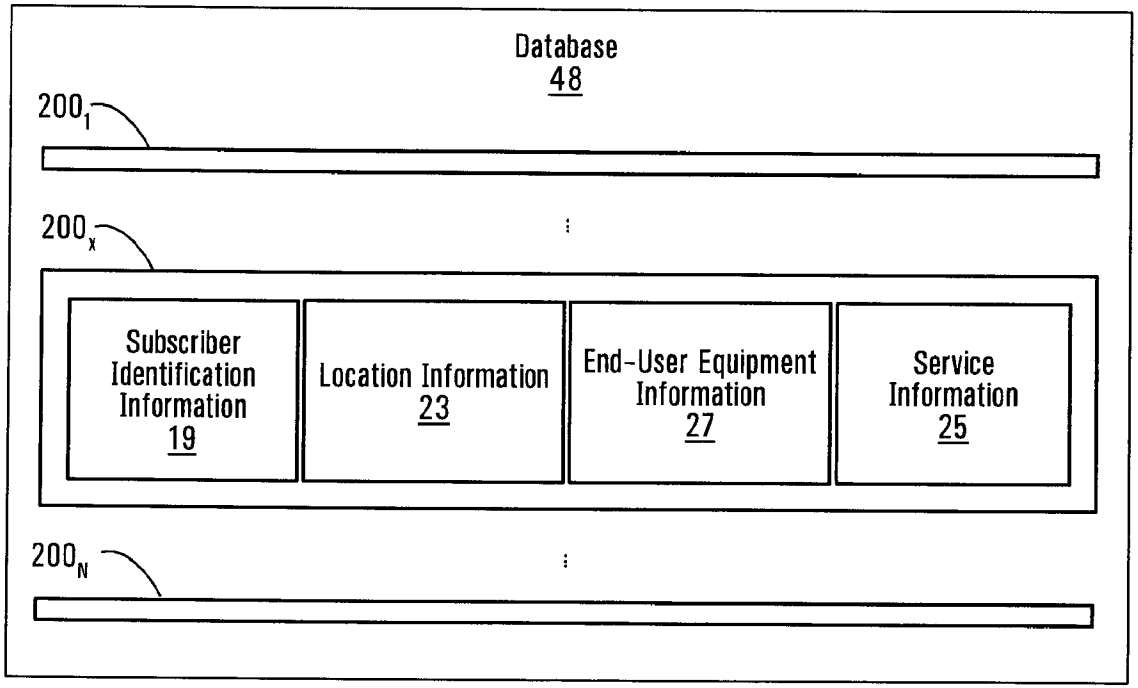
FIG. 2 shows an example of potential contents of a database of a communication apparatus of the communications network shown in FIG. 1.

FIG. 2 shows an example of potential contents of the database 48. In this example, the database 48 stores a plurality of records $\mathbf{200}_1$-$\mathbf{200}_N$, where each of these records is associated with a subscription to communication services provided by the service provider to a respective one of the end-user premises $\mathbf{18}_1$-$\mathbf{18}_N$. In other words, each of the end-user premises $\mathbf{18}_1$-$\mathbf{18}_N$ is associated with a different subscriber (i.e., a person or a group of persons) to which the service provider provides communication services. The database 48 may store other records associated with other subscriptions that are associated with other end-user premises which are served by the service provider.

The record $\mathbf{200}_x$ is associated with the subscriber to which communication services are provided at the end-user premise $\mathbf{18}_x$ and includes various types of information. More particularly, in this example, the record $\mathbf{200}_x$ includes:

- subscriber identification information 19 identifying the subscriber. For example, the subscriber identification information 19 may include an account number (e.g., a phone number) and/or another subscriber identifier (e.g., a name);

location information 23 indicating a physical location of the end-user premise $\mathbf{18}_x$. For example, the location information 23 may include a civic address, a set of geo-coordinates, and/or any other information that indicates the physical location of the end-user premise $\mathbf{18}_x$;

end-user equipment information 27 regarding the end-user equipment $\mathbf{10}_x$ at the end-user premises $\mathbf{18}_x$, which includes information regarding each of one or more pieces of equipment of the end-user equipment $\mathbf{10}_x$. For example, the information regarding a given piece of equipment of the end-user equipment $\mathbf{10}_x$ may include an identifier of the given piece of equipment, such as: a Media Access Control (MAC) address, an Ethernet hardware address (EHA), or another hardware identifier of the given piece of equipment; an IP address assigned to the given piece of equipment; a URI (e.g., a SIP URI) identifying the given piece of equipment; or any other information that identifies the given piece of equipment; and service information 25 regarding one or more communication services provided to the subscriber by the service provider. For example, the service information 25 may comprise call processing information that is related to processing of calls destined for or originated by the subscriber and that is used by the communication apparatus 40 to process such calls. In some cases, the call processing information may relate to one or more telephony features (e.g., call forwarding, call waiting, calling line identification (CLID) display, etc.) that may be subscribed to by the subscriber.

While this example illustrates certain information that can be included in the records $\mathbf{200}_1$-$\mathbf{200}_N$ of the database 48, various other information may be included in these records in other embodiments. In addition, while it is depicted in FIG. 1 as being one component, the database 48 may be distributed in nature. For example, in some embodiments, the database 48 can have portions of its content stored in different data storage media possibly located in different components of the communication apparatus 40 that are linked by one or more physical (i.e., wired or wireless) links.

The routing entity 44 is operative to cause one or more actions to be performed based on one or more decisions taken by the processing entity 42 with respect to a given communication, such as route information conveyed by the given communication to a certain piece of equipment which may be, for instance, a certain end-user device or a certain network element (e.g., a router). For example, the routing entity 44 may cause information pertaining to the given communication to be routed via the packet-switched network 32, the circuit-switched network 34, or the mobile network 36. To that end, the routing entity 44 may interact with one or more gateways interfacing with the packet-switched network 32, the circuit-switched network 34, and the mobile network 36

In some embodiments, the processing entity 42, the routing entity 44 and the database 48 may be implemented by a common network component. For example, in some embodiments, the processing entity 42, the routing entity 44 and the database 48 may be implemented by a softswitch or other computer platform. Alternatively, in other embodiments, the processing entity 42, the routing entity 44 and the database 48 may be implemented by two or more different network components that are linked by one or more physical (i.e., wired or wireless) links. For example, in some embodiments, the processing entity 42, the routing entity 44 and the database 48 may be implemented by two or more softswitches or other computer platforms.

The end-user equipment $\mathbf{10}_x$ at the end-user premise $\mathbf{18}_x$ comprises various pieces of equipment that can be used to effect communications, including telephone calls, accesses to data network sites, alarm system communications, and/or other communications (e.g., television signals). More particularly, the end-user equipment $\mathbf{10}_x$ at the end-user premise $\mathbf{18}_x$ comprises one or more end-user devices configured to effect communications, such as: one or more telephones, each of which may be, for instance, a wired Plain Old Telephony System (POTS) phone (including a cordless phone), a Voice-over-Internet Protocol (VoIP) phone, a POTS phone equipped with an analog terminal adapter (ATA), a softphone (i.e., a computer equipped with telephony software), or a telephony-enabled television unit (e.g., a set-top box connected to a television and a remote control); one or more computers, each of which may comprise, for instance, a desktop computer, a laptop computer or another personal computer (PC); one or more alarm system devices of an alarm system (sometimes also referred to as a "security system"), each of which may comprise, for instance, a door or window opening detector, a smoke detector, a motion detector, a glass break detector and/or another detector, a controller, and/or another piece of equipment of the alarm system; and/or one or more other end-user devices (e.g., a television unit).

Also, in this embodiment, the end-user equipment $\mathbf{10}_x$, at the end-user premise $\mathbf{18}_x$ comprises a communication apparatus $\mathbf{20}_x$ that is connected to the one or more end-user devices at the end-user premise $\mathbf{18}_x$ and to the communication link $\mathbf{21}_x$ reaching the end-user premise $\mathbf{18}_x$ in order to allow these one or more end-user devices to communicate over the communications network 12 via the communication link $\mathbf{21}_x$. The communication apparatus $\mathbf{20}_x$ at the end-user premise $\mathbf{18}_x$ can thus be viewed as a communications center or hub through which communications originated by, destined for, or in progress at the one or more end-user devices at the end-user premise $\mathbf{18}_x$ are effected via the communication link $\mathbf{21}_x$ reaching the end-user premise $\mathbf{18}_x$. Also, as they are interconnected via one or more wired links and/or wireless links at the end-user premise $\mathbf{18}_x$, the communication apparatus $\mathbf{20}_x$, and the one or more end-user devices at the end-user premise $\mathbf{18}_x$ are part of a local network at the end-user premise $\mathbf{18}_x$.

In some situations, an undesirable event such as a fire, an intrusion or a medical emergency may occur at the end-user premise $\mathbf{18}_x$. In such situations, phones, computers, alarm system devices and/or other pieces of equipment of the end-user equipment $\mathbf{10}_x$ at the end-user premise $\mathbf{18}_x$ may be used to effect communications to report or otherwise deal with the undesirable event. For example, if a detector (e.g., a smoke detector, a glass break detector, etc.) of an alarm system of the end-user equipment $\mathbf{10}_x$ detects a fire or an intrusion at the end-user premise $\mathbf{18}_x$, the alarm system may, in addition to emitting an audible alarm signal at the end-user premise $\mathbf{18}_x$, report the fire or intrusion to an alarm monitoring central. As another example, if someone at the end-user premise $\mathbf{18}_x$ experiences a medical emergency (i.e., an injury or illness that is acute and poses an immediate risk to that person's life or long term health), a telephone of the end-user equipment $\mathbf{10}_x$ may be used to call emergency medical services.

However, it may sometimes be desirable and/or more appropriate to notify individuals at other ones of the end-user premises $\mathbf{18}_1$-$\mathbf{18}_N$ of an undesirable event at the end-user premise $\mathbf{10}_x$. For example, if a fire breaks out at the end-user premise $\mathbf{10}_x$, it may be desirable to notify individuals at neighboring ones of the end-user premises $\mathbf{18}_1$-$\mathbf{18}_N$ such that they may proceed to evacuate in view of potential propagation of the fire. As another example, if a person at the end-user premise $10_x$, experiences a medical emergency, it may be desirable to notify people at neighboring ones of the end-user premises $18_1$-$18_N$ such that they can perhaps go and help the person in need until emergency medical personnel arrives on scene.

In accordance with an embodiment of the invention, and as further discussed below, upon occurrence of a particular event at the end-user premise $18_x$, the communication apparatus $20_x$ of the end-user equipment $10_x$ at the end-user premise $18_x$ can cause a wireless communication link to be established between the end-user equipment $10_x$ and the end-user equipment $10_y$ ($1 \leq y \leq N$; $y \neq x$) at the end-user premise $18_y$ in order transmit information to the end-user equipment $10_y$ via this wireless communication link to instruct the end-user equipment $10_y$ to issue a notification concerning the particular event. For example, the notification may comprise a message displayed on a screen of an end-user device (e.g., a phone, a computer, a television unit, etc.) of the end-user equipment $10_y$ and/or an audible alarm signal emitted by a speaker of the end-user device $10_y$ to notify a party (i.e., a person or group of persons) at the end-user premise $18_y$ of the particular event at the end-user premise $18_x$ and/or of a certain action to be performed with respect to the particular event at the end-user premise $18_x$ (e.g., evacuate the end-user premise $18_y$, check on the end-user premise $18_x$ and/or someone at the end-user premise $18_x$, etc.). This provides a "local" notification mechanism that may assist in avoiding negative, and in some cases, harmful or fatal consequences.

Figure 3:
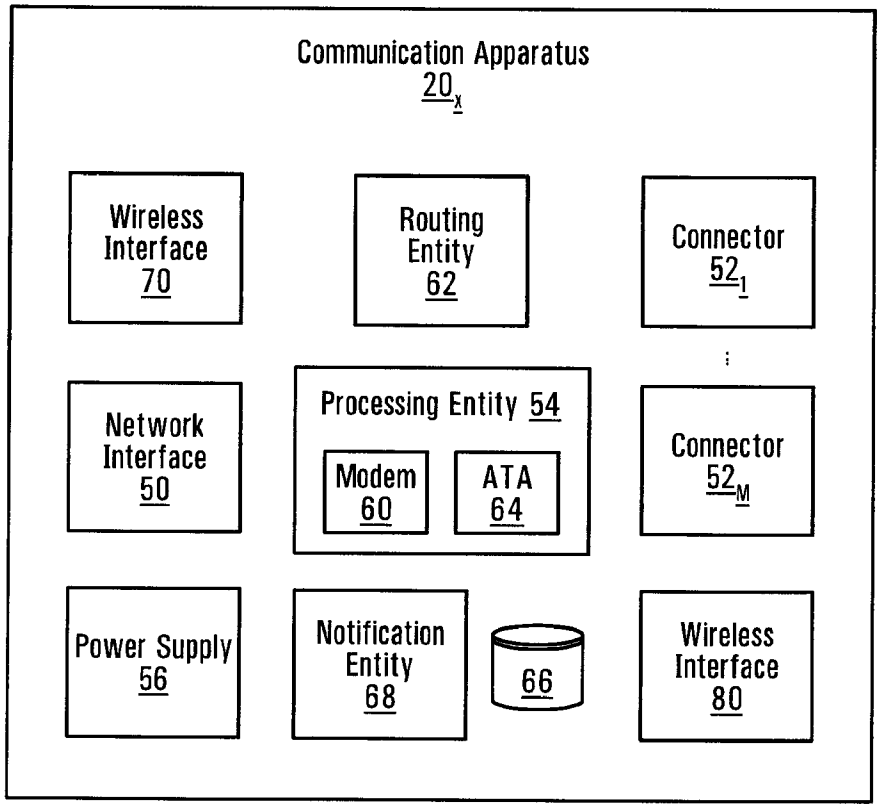
FIG. 3 shows a communication apparatus of the end-user equipment located at one of the end-user premises shown in FIG. 1.

With additional reference to FIG. 3, the communication apparatus $20_x$ of the end-user equipment $10_x$ at the end-user premise $18_x$ comprises suitable hardware, firmware, software or a combination thereof for implementing a plurality of functional entities, including, in this embodiment, a network interface 50, a plurality of connectors $52_1$-$52_M$, a wireless interface 80, a wireless interface 70, a processing entity 54, a notification entity 68, a routing entity 62, a database 66, and a power supply 56. In some embodiments, these entities of the communication apparatus $20_x$ may be integrated into a terminal installed at a suitable location (e.g., a basement or other location) at the end-user premise $18_x$. In other embodiments, these entities of the communication apparatus $20_x$ may be part of two or more devices interconnected to one another via one or more physical links.

The network interface 50 is connected to the communication link $21_x$ reaching the end-user premise $18_x$ in order to provide an interface between the end-user equipment $10_x$ and the communications network 12. For example, in some embodiments, the network interface 50 may be implemented by a network interface device (NID) and a channel service unit/data service unit (CSU/DSU). In other embodiments, the network interface 50 may be implemented in various other manners depending on the nature of the communication link $21_x$.

The connectors $52_1$-$52_M$ enable connection of one or more end-user devices of the end-user equipment $10_x$ to the communication apparatus $20_x$. For example, each of the connectors $52_1$-$52_M$ may be an RJ11 connector (e.g., for connecting a wired POTS phone), an RJ45 connector (e.g., for connecting a computer or a VoIP phone), an alarm system connector for connecting an alarm system device (e.g., a controller or a detector of an alarm system) or any other type of connector (e.g., a connector for connecting a television set-top box).

The wireless interface 80 is configured to wirelessly exchange information with one or more end-user devices of the end-user equipment $10_x$ at the end-user premise $18_x$. More particularly, the wireless interface 80 comprises a wireless transmitter and a wireless receiver to wirelessly exchange information with one or more end-user devices of the end-user equipment $10_x$. For example, in some embodiments, the wireless interface 80 may be implemented by a wireless router based on WiFi (IEEE 802.11) technology or other wireless communication technologies.

The wireless interface 70 can be used to establish a wireless communication link between the end-user equipment $10_x$ at the end-user premise $18_x$ and the end-user equipment $10_y$ at the end-user premise $18_y$. More particularly, the wireless interface 70 comprises a wireless transmitter and a wireless receiver to wirelessly exchange information with the end-user equipment $10_y$ at the end-user premise $18_y$. For example, in some embodiments, the wireless interface 70 may be based on WiFi technology or other wireless communication technologies.

The processing entity 54 is configured to receive requests for communications originated by one or more end-user devices of the end-user equipment $10_x$. For example, the processing entity 54 may receive a request for a telephone call originated by a telephone of the end-user equipment $10_x$, a request for an access to a data network site originated by a computer of the end-user equipment $10_x$, a request for an alarm system communication originated by an alarm system device, and/or a request for another type of communication originated by another end-user device of the end-user equipment $10_x$.

The processing entity 54 is also configured to process information pertaining to communications effected by the end-user equipment $10_x$. More particularly, in this embodiment, the processing entity 54 comprises a modem 60 and an analog telephony adapter (ATA) 64. The modem 60 is configured to modulate an analog carrier signal to encode digital information for transmission via the network interface 50 and to demodulate an analog carrier signal received via the network interface 50 to decode information it conveys. For example, in some embodiments, the modem 60 may be a digital subscriber line (DSL) modem or a cable modem, depending on the nature of the communication link $21_x$. The ATA 64 is configured to convert analog telephony signals from any wired POTS phone that may be part of the end-user equipment $10_x$ and connected to one of the connectors $52_1$-$52_M$ into digital information to be processed by the routing entity 62 and the modem 60, and vice versa.

The routing entity 62 is configured to cause information transmitted by or destined for the end-user equipment $10_x$ to be exchanged over the communications network 12. More particularly, in this embodiment, the routing entity 62 routes information received via the connectors $52_1$-$52_M$ and/or the wireless interface 80 towards the modem 60 for transmission via the network interface 50 and routes information received from the modem 60 towards the connectors $52_1$-$52_M$ and/or the wireless interface 80 for transmission to one or more end-user devices of the end-user equipment $10_x$.

When certain events occur at the end-user premise $18_x$, the processing entity 54 is configured to obtain indications of these events. For instance, in some embodiments, the processing entity 54 may obtain an indication of a particular event at the end-user premise $18_x$ based on information received at the communication apparatus $20_x$ in relation to the particular event, such as information transmitted by one or more end-user devices of the end-user equipment $10_x$ that are used in relation to the particular event. For example, if a detector (e.g., a smoke detector, a glass break detector, etc.) of an alarm system of the end-user equipment $10_x$ detects a fire or an intrusion at the end-user premise $18_x$, the alarm system may, in addition to emitting an audible alarm signal at the end-user premise $18_x$, effect an alarm system communication through the communication apparatus $20_x$ and over the communications network 12 to report the fire or intrusion to an alarm monitoring central. Based on information pertaining to the alarm system communication (e.g., an identifier of the alarm system that originated the alarm system communication), the processing entity 54 obtains an indication of the fire or intrusion at the end-user premise $18_x$. As another example, if someone at the end-user premise $18_x$ experiences an emergency (e.g., a medical emergency), a telephone of the end-user equipment $10_x$ may be used to initiate an emergency phone call (e.g., a "911" call) to request emergency services. Based on information pertaining to the emergency phone call (e.g., the "911" telephone number being called), the processing entity 54 obtains an indication of the emergency at the end-user premise $18_x$.

Upon obtaining an indication of a particular event at the end-user premise $18_x$, the processing entity 54 determines whether a notification concerning the particular event is to be issued at another one of the end-user premises $18_1$-$18_N$, say the end-user premise $18_y$. That is, depending on the nature of the particular event, it may be desirable and/or more appropriate to notify a party at the end-user premise $18_y$ of the particular event at the end-user premise $18_x$ and/or of a certain action to be performed with respect to the particular event at the end-user premise $18_x$ (e.g., evacuate the end-user premise $18_y$, check on the end-user premise $18_x$ and/or someone at the end-user premise $18_x$, etc.) For example, if it obtains an indication of a fire, an intrusion or an emergency at the end-user premise $18_x$, the processing entity 54 may determine that a notification concerning the fire, intrusion or emergency is to be issued at the end-user premise $18_y$, in view of the potential criticality of such an event. In other cases, the processing entity 54 may obtain indications of events at the end-user premise $18_x$ for which it determines that no notification is to be issued at other ones of the end-user premises $18_1$-$18_N$.

When the processing entity 54 determines that a notification concerning a particular event is to be issued at the end-user premise $18_y$, the notification entity 68 causes the wireless interface 70 to establish a wireless communication link with the end-user equipment $10_y$ at the end-user premise $18_y$. The notification entity 68 can proceed to cause the wireless interface 70 to transmit information to the end-user equipment $10_y$ via the established wireless communication link to instruct the end-user equipment $10_y$ to issue a notification concerning the particular event. For example, the notification may comprise a message displayed on a screen of an end-user device (e.g., a phone, a computer, a television unit, etc.) of the end-user equipment $10_y$ and/or an audible alarm signal emitted by a speaker of the end-user device $10_y$. The notification serves to notify a party at the end-user premise $18_y$ of the particular event at the end-user premise $18_x$ and/or of a certain action to be performed with respect to the particular event at the end-user premise $18_x$ (e.g., evacuate the end-user premise $18_y$, check on the end-user premise $18_x$ and/or someone at the end-user premise $18_x$, etc.).

Figure 4:
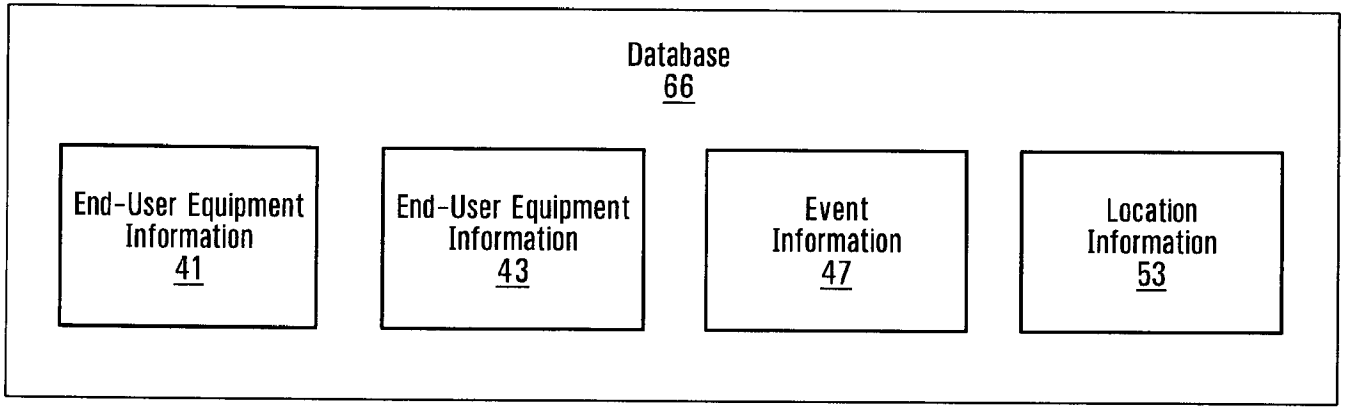
FIG. 4 shows an example of potential contents of a database of the communication apparatus shown in FIG. 3.

The database 66 stores information that can be used by the communication apparatus $20_x$ in operation. FIG. 4 shows an example of potential contents of the database 66.

In this example, the database 66 stores end-user equipment information 41 regarding the end-user equipment $10_x$, which includes information regarding each of one or more pieces of equipment of the end-user equipment $10_x$ (e.g., the communication apparatus $20_x$ and the one or more end-user devices at the end-user premise $18_x$). More particularly, in this example, the information regarding a given piece of equipment of the end-user equipment $10_x$ may include:

- an identifier of the given piece of equipment, such as a MAC address, EHA, or other hardware identifier of that piece of equipment, an IP address assigned to that piece of equipment, a URI (e.g., a SIP URI) identifying the given piece of equipment, or any other information that identifies that piece of equipment; and
- depending on the nature of the given piece of equipment, access information to be provided to the given piece of equipment in order to access (i.e., make use of) that piece of equipment. For example, the access information for the given piece of equipment may comprise a code, such as a password or a wireless network key (e.g., a Wi-Fi Protected Access (WPA) key).

In addition, in this example, the database 66 stores end-user equipment information 43 regarding end-user equipment at one or more other ones of the end-user premises $18_1$-$18_N$ that is within wireless range of the end-user equipment $10_x$ at the end-user premise $18_x$. For example, if the end-user equipment $10_z$ ($1 \leq z \leq N$; $z \neq x$) at the end-user premise $18_z$ is within wireless range of the end-user equipment $10_x$ at the end-user premise $18_x$, the end-user equipment information 43 may include information regarding each of one or more pieces of equipment of the end-user equipment $10_z$ (e.g., the communication apparatus $20_z$ and the one or more end-user devices at the end-user premise $18_z$). For instance, the information regarding a given piece of equipment of the end-user equipment $10_z$ may include: an identifier of the given piece of equipment such as a MAC address, EHA, or other hardware identifier of that piece of equipment, an IP address assigned to that piece of equipment, a URI (e.g., a SIP URI) identifying the given piece of equipment, or any other information that identifies that piece of equipment; and, depending on the nature of the given piece of equipment, access information to be provided to the given piece of equipment in order to make use of that piece of equipment (e.g., a password or a wireless network key).

The end-user equipment information 41 regarding the end-user equipment $10_x$ may be provided in the database 66 in various ways. For example, in some cases, the identifier of and/or access information for any piece of equipment of the end-user equipment $10_x$ may be provided in the database 66 by a user at the end-user premise $18_x$ when setting up that piece of equipment. In other cases, the identifier of and/or access information for any piece of equipment of the end-user equipment $10_x$ may be provided in the database 66 by the service provider, for example, by the communication apparatus 40 transmitting this information via the communication link $21_x$.

Similarly, the end-user equipment information 43 regarding end-user equipment at one or more other ones of the end-user premises $18_1$-$18_N$ that is within wireless range of the end-user equipment $10_x$ at the end-user premise $18_x$ may be provided in the database 66 in various ways. For example, in some cases, the end-user equipment information 43 may be provided in the database 66 by the service provider, for example, by the communication apparatus 40 transmitting this information via the communication link $21_x$. In other cases, the end-user equipment information 43 may be provided in the database 66 during a provisioning phase (e.g., when the communication apparatus $20_x$ is initially set up at the end-user premise $18_x$) using an exchange of information between the communication apparatus $20_x$ at the end-user premise $18_x$ and the communication apparatus at each of these one or more other ones of the end-user premises $18_1$-$18_N$ that is within wireless range of the end-user equipment $10_x$ at the end-user premise $18_x$.

Furthermore, in this example, the database 66 stores event information 47 regarding one or more events that may occur at the end-user premise $18_x$ and that require issuance of notifications concerning these events at one or more other ones of the end-user premises $18_1$-$18_N$. For example, in some embodiments, the event information 47 may comprise an identifier of each of one or more pieces of equipment that, when specifying an origin or a destination of information conveyed via the communication apparatus $20_x$, can be indicative of a particular event at the end-user premise $18_x$ for which a notification is to be issued at another one of the end-user premises $18_1$-$18_N$. As mentioned previously, the identifier of a given piece of equipment may comprise a MAC address, EHA, or other hardware identifier of that piece of equipment, an IP address assigned to that piece of equipment, a URI (e.g., a SIP URI) identifying that piece of equipment, a telephone number, or any other information that identifies that piece of equipment.

For instance, in some embodiments, the event information 47 may comprise: a MAC address, EHA, or other hardware identifier, an IP address, a URI (e.g., a SIP URI) or any other information identifying a given alarm system device (e.g., a detector or controller) of an alarm system of the end-user equipment $10_x$, which is such that any alarm system communication effected using the given alarm system device is indicative of a particular event (e.g., a fire or intrusion) at the end-user premise $18_x$; a telephone number, an IP address, a URI (e.g., a SIP URI), a MAC address, EHA, or other hardware identifier, or any other information identifying a given phone, which is such that any telephone call originated by or destined for the given phone is indicative of a particular event (e.g., an emergency such as a medical emergency when the telephone call is a "911" or other emergency call) at the end-user premise $18_x$; and/or any other identifier of a piece of equipment which, when specifying an origin or a destination of information conveyed via the communication apparatus $20_x$, can be indicative of a particular event at the end-user premise $18_x$.

The event information 47 may be provided in the database 66 in various ways. For example, in some cases, part or all of the event information 47 may be provided in the database 66 by a user at the end-user premise $18_x$ when setting up the communication apparatus $20_x$. In other cases, part or all of the event information 47 may be provided in the database 66 by the service provider, for example, by the communication apparatus 40 transmitting this information via the communication link $21_x$.

Also, in this example, the database 66 stores location information 53 indicating the physical location of the end-user premise $18_x$. For instance, the location information 53 may comprise a civic address, a set of geo-coordinates, and/or any other information that indicates the physical location of the end-user premise $18_x$. The location information 53 may be provided in the database 66 in various ways. For example, in some cases, the location information 53 may be provided in the database 66 by a user at the end-user premise $18_x$ when setting up the communication apparatus $20_x$. In other cases, the location information 53 may be provided in the database 66 by the service provider, for instance, by the communication apparatus 40 transmitting this location information via the communication link $21_x$.

While this example illustrates certain information that can be included in the database 66, other information may be included in that database in other embodiments. Also, while it is depicted in FIG. 3 as being one component, the database 66 may be distributed in nature. For example, in some embodiments, the database 66 can have portions of its content stored in different data storage media of the communication apparatus $20_x$.

The power supply 56 is configured to power the communication apparatus $20_x$ using electrical power from an electrical network of the end-user premise $18_x$. In addition, the power supply 56 is capable of powering the communication apparatus $20_x$ in cases where the electrical network of the end-user premise $18_x$ does not provide sufficient electrical power (including no electrical power at all) for operation of the communication apparatus $20_x$ (e.g., due to a power outage or a malfunction in the electrical network). For example, the power supply 56 may comprise one or more batteries capable of powering the communication apparatus $20_x$ for a prolonged period of time (e.g., several hours or a few days) before being depleted. The power supply 56 may also comprise charging circuitry for recharging the one or more batteries using electrical power from the electrical network of the end-user premise $18_x$.

While they are shown as distinct entities, different ones of the functional entities of the communication apparatus $20_x$ may be implemented by a common device. For example, the wireless interface 70 and the wireless interface 80 may be implemented by a common wireless router (e.g., a WiFi router). As another example, one or more of the connectors $52_1$-$52_M$ and the ATA 64 may be implemented by a common ATA device. As yet another example, the modem 60 and the network interface 50 may be implemented by a common network interface device. As yet another example, the routing entity 62 and the notification entity 68 may be implemented by a common routing device. As yet another example, the processing entity 54, the routing entity 62 and the notification entity 68 may be implemented by a common processing platform. As yet another example, the wireless interface 70, the wireless interface 80, the processing entity 54, the routing entity 62 and the notification entity 68 may be implemented by a common device.

Also, while the communication apparatus $20_x$ is configured in a particular manner in this embodiment, the communication apparatus $20_x$, may be configured in various manners in other embodiments. For example, in some embodiments, the ATA 64 may be omitted in cases where the end-user equipment $10_x$ at the end-user premise $18_x$ does not comprise any POTS phone.

Figure 5A:
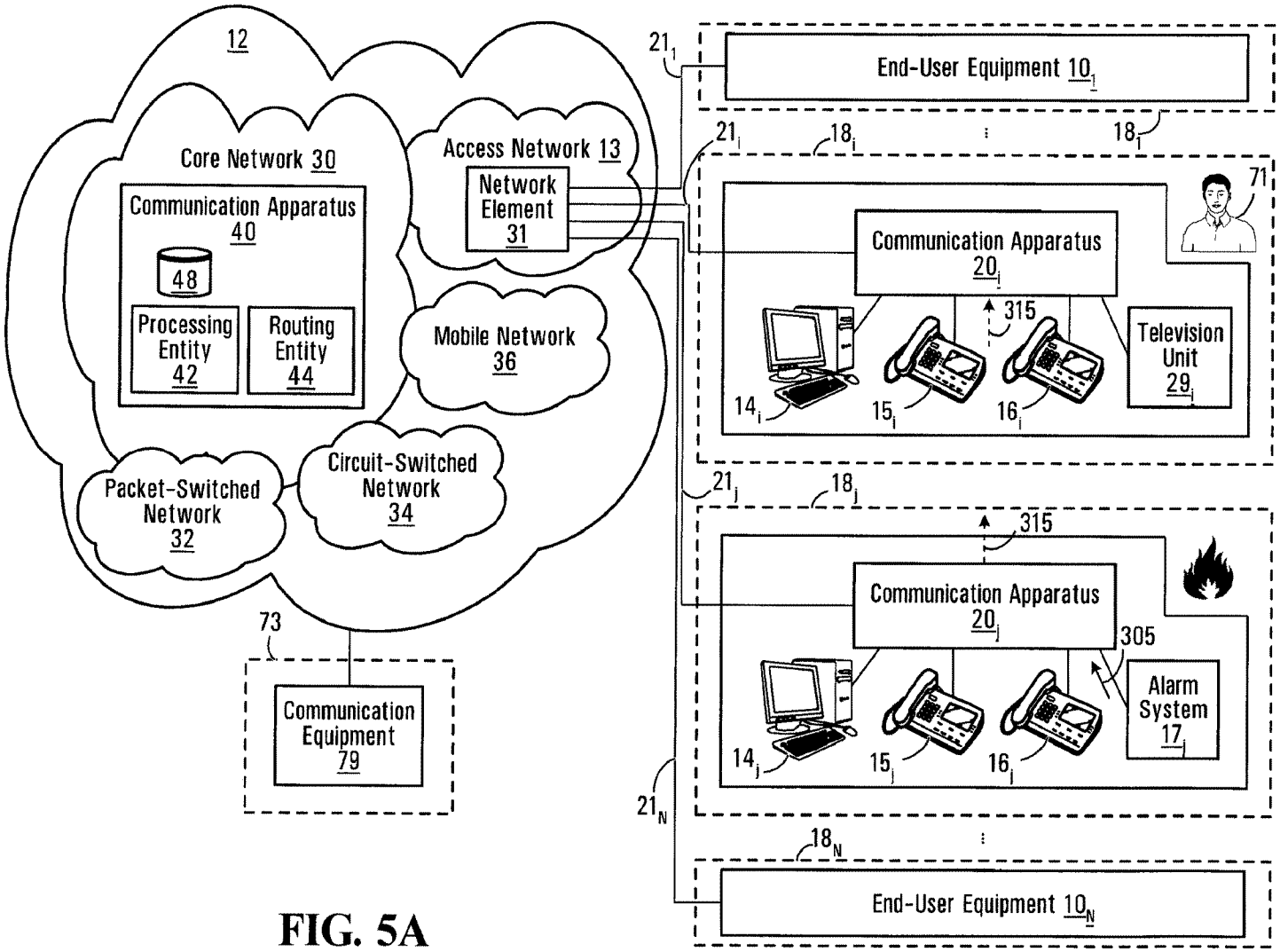
FIGS. 5A and 5B show an example in which a wireless communication link is established between the end-user equipment at a first one of the end-user premises and the end-user equipment at a second one of the end-user premises in order to allow the end-user equipment at the second one of the end-user premises to issue a notification concerning a particular event at the first one of the end-user premises.
Figure 5B:
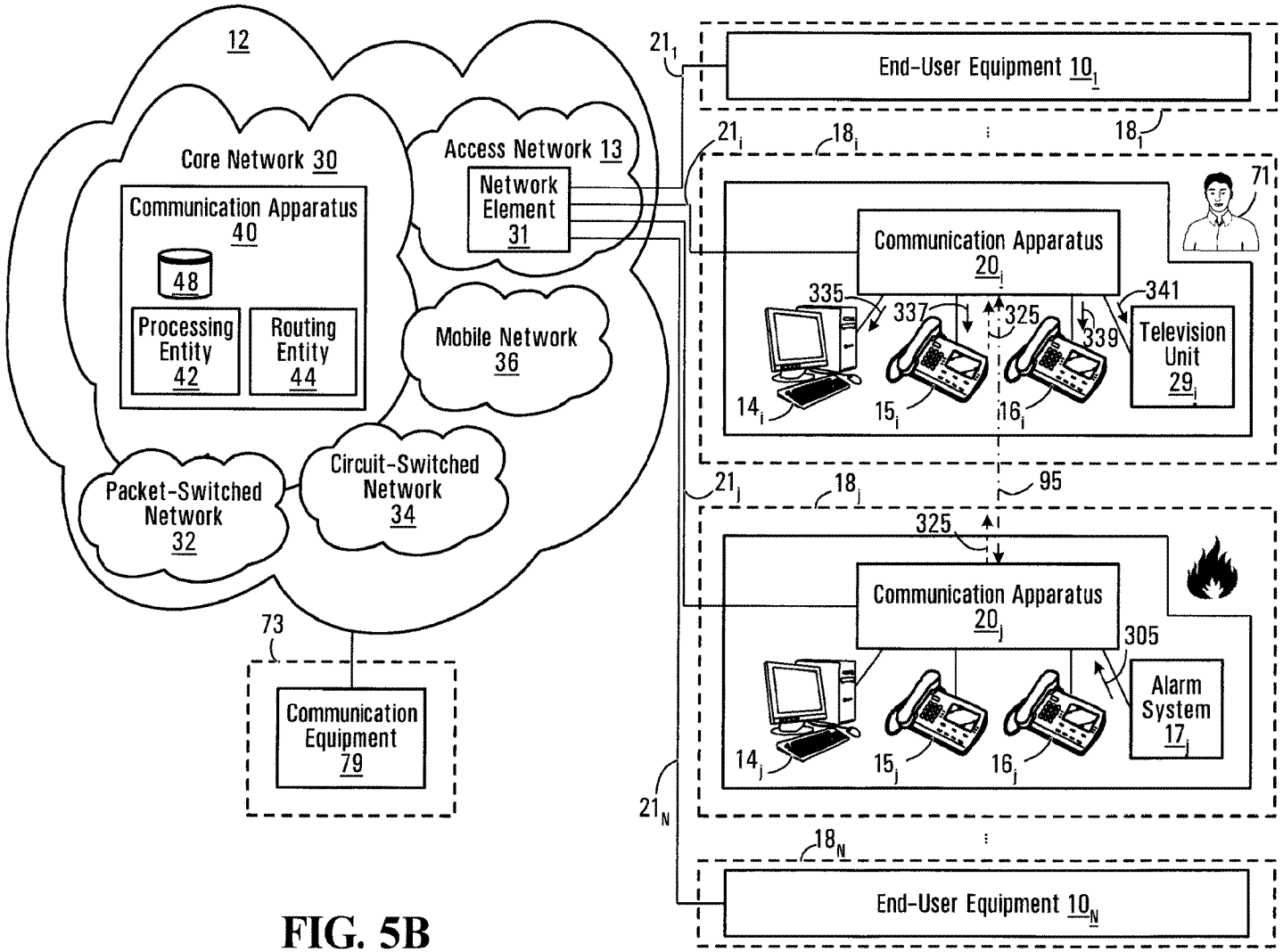

Turning to FIGS. 5A and 5B, an example illustrating how a party at the end-user premise $18_i$ can be notified when a particular event occurs at the end-user premise $18_j$, will now be considered.

In this example, the end-user equipment $10_j$ comprises, in addition to the communication apparatus $20_j$, a plurality of end-user devices, including a computer $14_j$, a VoIP phone $15_j$, a POTS phone $16_j$, and alarm system devices (e.g., detectors, a controller) of an alarm system $17_j$, which are connected to the communication apparatus $20_j$ via its connectors $52_1$-$52_M$ and/or its wireless interface 80. Thus, in this case, the communication apparatus $20_j$, the computer $14_j$, the VoIP phone $15_j$, the POTS phone $16_j$, and the alarm system $17_j$ are part of a local network at the end-user premise $18_j$.

For purposes of this example, it is assumed that a particular event occurs at the end-user premise $18_j$. More particularly, in this example, it is assumed that a fire breaks out at the end-user premise $18_j$. A smoke detector of the alarm system $17_j$ detects smoke produced by the fire and issues a signal indicative of the fire which, upon being received by a controller of the alarm system $17_j$, results in the alarm system $17_j$ effecting an alarm system communication over the communications network 12 to report the fire to an alarm monitoring central 73. In this example, the alarm system communication is destined for communication equipment 79 located at the alarm monitoring central 73. For instance, the communication equipment 79 may comprise a telephone and/or a computer for which the alarm system communication is destined.

As shown in FIG. 5A, the communication apparatus $20_j$ receives information 305 from the alarm system $17_j$. The information 305 pertains to the alarm system communication effected by the alarm system $17_j$ due to issuance of the signal by the smoke detector.

The information 305 comprises information indicative of a destination of the alarm system communication. For instance, in this case, the destination of the alarm system communication is specified by an identifier of the communication equipment 79, such as a telephone number, an IP address, a URI (e.g., a SIP URI), a MAC address, EHA or other hardware identifier, and/or any other information identifying the communication equipment 79.

The information 305 also comprises information indicative of detection of the fire at the end-user premise $18_x$. For example, in this embodiment, the information 305 comprises an identifier of the smoke detector of the alarm system $17_j$ which has detected the smoke produced by the fire, such as an IP address, a URI (e.g., a SIP URI), a MAC address, EHA or other hardware identifier, and/or any other information identifying the smoke detector. For purposes of this example, it is assumed that the identifier of the smoke detector included in the information 305 is an IP address, say "10.10.2.7".

The routing entity 62 of the communication apparatus $20_j$ transmits the information 305 to the communication equipment 79 over the communications network 12 via the communication link $21_j$. An operator and/or a computer at the alarm monitoring central 73 can perform certain actions to handle the alarm system communication reporting the fire at the end-user premise $18_x$, such as dispatch firefighters and possibly other emergency personnel on scene.

Meanwhile, the processing entity 54 of the communication apparatus $20_j$ determines whether the information 305 transmitted by the alarm system $17_j$ is indicative of any event at the end-user premise $18_x$ for which a notification is to be issued at another one of the end-user premises $18_1$-$18_N$. More particularly, in this embodiment, the processing entity 54 determines whether any identifier included in the information 305 corresponds to any identifier included in the event information 47 in the database 66. Thus, in this example, the processing entity 54 determines whether the identifier of the communication equipment 79 of the alarm monitoring central 73 or the IP address "10.10.2.7" identifying the smoke detector of the alarm system $17_j$ included in the information 305 corresponds to any identifier included in the event information 47 in the database 66. If not, the processing entity 54 performs no further action directed to issuance of a notification at another one of the end-user premises $18_1$-$18_N$.

For purposes of this example, assume that the event information 47 in the database 66 of the communication apparatus $20_j$ includes: the IP address "10.10.2.7" identifying the smoke detector of the alarm system $17_j$; the IP address, say "10.10.2.9", identifying a glass break detector of the alarm system $17_j$; the emergency telephone number "911"; and the telephone number, say "(555) 555-8894", of a poison control center. The processing entity 54 thus determines that the IP address "10.10.2.7" included in the information 305 corresponds to the IP address "10.10.2.7" included in the event information 47 in the database 66. Accordingly, since the IP address "10.10.2.7" identifies the smoke detector of the alarm system $17_j$, the processing entity 54 obtains an indication of the fire at the end-user premise $18_j$ and determines that a notification concerning this fire is to be issued at another one of the end-user premises $18_1$-$18_N$.

Thus, the communication apparatus $20_j$ attempts to cause issuance of a notification concerning the fire at the end-user premise $18_j$ at another one of the end-user premises $18_1$-$18_N$. More particularly, the communication apparatus $20_j$ attempts to establish a wireless communication link via which it can transmit information causing issuance of such a notification at another one of the end-user premises $18_1$-$18_N$.

The processing entity 54 of the communication apparatus $20_j$ accesses the database 66 of the communication apparatus $20_j$ to obtain the end-user equipment information 43 regarding end-user equipment at one or more other ones of the end-user premises $18_1$-$18_N$ that is within wireless range of the end-user equipment $10_j$ at the end-user premise $18_j$.

In this example, it is assumed that the end-user equipment information 43 in the database 66 of the communication apparatus $20_j$ includes end-user equipment information regarding the end-user equipment $10_i$ at the end-user premise $18_i$, which is within wireless range of the end-user equipment $10_j$ at the end-user premise $18_j$. The end-user equipment $10_i$ comprises, in addition to the communication apparatus $20_i$, a plurality of end-user devices, including a computer $14_1$, a VoIP phone $15_i$, another VoIP phone $16_i$, and a television unit $29_i$, which are connected to the communication apparatus $20_i$ via its connectors $52_1$-$52_M$ and/or its wireless interface 80. Thus, in this case, the communication apparatus $20_i$, the computer $14_i$, the VoIP phone $15_i$, the VoIP phone $16_i$, and the television unit $29_i$ are part of a local network at the end-user premise $18_i$. It is also assumed in this example that the end-user equipment information 43 included in the database 66 of the communication apparatus $20_j$ at the end-user premise $18_j$ includes an identifier of the communication apparatus $20_i$ (e.g., a MAC address, EHA, or other hardware identifier of the communication apparatus $20_i$, an IP address assigned to communication apparatus $20_i$, a URI such as a SIP URI, or any other information that identifies the communication apparatus $20_i$) and access information to be provided to the communication apparatus $20_i$ in order to make use of the communication apparatus $20_i$ (e.g., a password or a wireless network key).

While in this example the end-user equipment information 43 in the database 66 pertains only to the end-user equipment $10_i$ at the end-user premise $18_i$, in other examples, the end-user equipment information 43 in the database 66 may include identifiers and access information for end-user equipment at other ones of the end-user premises $18_1$-$18_N$. In such a case, the processing entity 54 of communication apparatus $20_j$ may use a selection process to select one or more of the communication apparatuses $20_1$-$20_N$ listed in the database 66 with which it may attempt to establish a wireless communication link. For example, the selection process may define one or more "preferred" ones of the communication apparatuses $20_1$-$20_N$ listed in the database 66 that are predetermined by one or more components of the communications network 12, such as the communication apparatus 40 of the core network 30. As another example, the selection process may allow the processing entity 54 of the communication apparatus $20_j$ to decide with which of the other ones of the communication apparatuses $20_1$-$20_N$ listed in the database 66 it should attempt to establish a wireless communication link. For instance, the processing entity 54 may evaluate the other ones of the communication apparatuses $\mathbf{20}_1$-$\mathbf{20}_N$ listed in the database 66 based on criteria such as their physical proximity, wireless signal strength and/or reported network traffic load, and/or other factors.

Upon retrieving the identifier and access information of the communication apparatus $\mathbf{20}_i$, the processing entity 54 of the communication apparatus $\mathbf{20}_j$ causes the notification entity 68 of the communication apparatus $\mathbf{20}_j$ to attempt to establish a wireless communication link between the communication apparatus $\mathbf{20}_j$ and the communication apparatus $\mathbf{20}_i$. More particularly, the processing entity 54 causes the notification entity 68 to wirelessly transmit information 315 to the communication apparatus $\mathbf{20}_1$ via the wireless interface 70 of the communication apparatus $\mathbf{20}_j$. The information 315 can be viewed as a request to access the communication apparatus $\mathbf{20}_i$. In this example, the information 315 includes the identifier and access information of the communication apparatus $\mathbf{20}_i$, as well as the identifier and access information of the communication apparatus $\mathbf{20}_j$, which the processing entity 54 retrieved from the end-user equipment information 41 included in the database 66 of the communication apparatus $\mathbf{20}_j$.

When it receives the information 315, the communication apparatus $\mathbf{20}_i$ attempts to validate the identifier and access information of the communication apparatus $\mathbf{20}_i$ that are included in the information 315. More particularly, the processing entity 54 of the communication apparatus $\mathbf{20}_i$ verifies whether the identifier and access information of the communication apparatus $\mathbf{20}_i$ that are included in the information 315 correspond to the identifier and access information of the communication apparatus $\mathbf{20}_i$ that are included in the end-user equipment information 41 in the database 66 of the communication apparatus $\mathbf{20}_i$. If not, the communication apparatus $\mathbf{20}_i$ may deny the request of the communication apparatus $\mathbf{20}_j$ to access the communication apparatus $\mathbf{20}_i$ and may take some other action. For instance, the communication apparatus $\mathbf{20}_i$ may send information back to the communication apparatus $\mathbf{20}_j$ indicating that access to the communication apparatus $\mathbf{20}_i$ is denied, and/or may send information to the communication apparatus 40 of the core network 30 to indicate that a failed connection attempt has occurred due to invalid credentials.

In this example, it is assumed that the identifier and access information of the communication apparatus $\mathbf{20}_i$ that are included in the information 315 indeed correspond to the identifier and access information of the communication apparatus $\mathbf{20}_i$ that are included in the end-user equipment information 41 in the database 66 of the communication apparatus $\mathbf{20}_i$. Therefore, as shown in FIG. 5B, the communication apparatus $\mathbf{20}_i$ grants access to the communication apparatus $\mathbf{20}_j$, resulting in establishment of a wireless communication link 95 between the communication apparatus $\mathbf{20}_j$ and the communication apparatus $\mathbf{20}_i$. In other words, in this example, the communication apparatus $\mathbf{20}_j$ wirelessly joins the local network at the end-user premise $\mathbf{18}_i$.

With the wireless communication link 95 being established, the notification entity 68 of the communication apparatus $\mathbf{20}_j$ transmits information 325 to the communication apparatus $\mathbf{20}_i$ via the wireless communication link 95. The information 325 instructs the end-user equipment $\mathbf{10}_i$ at the end-user premise $\mathbf{18}_i$ to issue a notification concerning the fire at the end-user premise $\mathbf{18}_j$.

More particularly, in this embodiment, the information 325 comprises information indicative of the fire at the end-user premise $\mathbf{18}_j$. Also, in this embodiment, the information 325 comprises the location information 53 indicative of the physical location of the end-user premise $\mathbf{18}_j$ at which the fire occurs, which is retrieved from the database 66 of the communication apparatus $\mathbf{20}_j$. The information 325 may also comprise information advising a party at the end-user premise $\mathbf{18}_i$ to evacuate this premise in view of the fire.

Upon receiving the information 325, the notification entity 68 of the communication apparatus $\mathbf{20}_i$ causes the end-user equipment $\mathbf{10}_i$ at the end-user premise $\mathbf{18}_i$ to issue a notification concerning the fire at the end-user premise $\mathbf{18}_j$. This notification can take on many forms in various embodiments.

For example, in some embodiments, the notification concerning the fire at the end-user premise $\mathbf{18}_j$ may comprise one or more visual messages displayed on one or more end-user devices of the end-user equipment $\mathbf{10}_i$. More particularly, in this example, the notification entity 68 of the communication apparatus $\mathbf{20}_i$ transmits information 335, 337, 339, 341 to the computer $\mathbf{14}_i$, the VoIP phone $\mathbf{15}_i$, the VoIP phone $\mathbf{16}_i$, and the television unit $\mathbf{29}_i$ via the connectors $\mathbf{52}_1$-$\mathbf{52}_M$ and/or the wireless interface 80 of the communication apparatus $\mathbf{20}_i$ to direct these end-user devices to display respective messages concerning the fire at the end-user premise $\mathbf{18}_j$. Upon receiving the information 335, 337, 339, 341, the computer $\mathbf{14}_i$, the VoIP phone $\mathbf{15}_i$, the VoIP phone $\mathbf{16}_i$, and the television unit $\mathbf{29}_i$ display respective visual messages concerning the fire at the end-user premise $\mathbf{18}_j$. These visual messages may have different content and/or formats, for instance, depending on display capabilities of the computer $\mathbf{14}_i$, the VoIP phone $\mathbf{15}_i$, the VoIP phone $\mathbf{16}_i$, and the television unit $\mathbf{29}_i$. For example, each message may be "Fire at neighbor's house! Evacuate immediately!" or any conceivable variant thereof.

Alternatively or additionally, in some embodiments, the notification concerning the fire at the end-user premise $\mathbf{18}_j$ may comprise one or more audible messages emitted by one or more end-user devices of the end-user equipment $\mathbf{10}_i$. For instance, in this example, the information 335, 337, 339, 341 transmitted to the computer $\mathbf{14}_i$, the VoIP phone $\mathbf{15}_i$ the VoIP phone $\mathbf{16}_i$, and the television unit $\mathbf{29}_i$ may also direct speakers of these end-user devices to emit audible messages accompanying the visual messages that they display.

As yet another possibility, in some embodiments, the notification concerning the fire at the end-user premise $\mathbf{18}_j$ may comprise an audible warning signal emitted by one or more end-user devices of the end-user equipment $\mathbf{10}_i$. For instance, in this example, the notification entity 68 of the communication apparatus $\mathbf{20}_i$ may transmit information to one or more of the computer $\mathbf{14}_i$, the VoIP phone $\mathbf{15}_i$, the VoIP phone $\mathbf{16}_i$ and the television unit $\mathbf{29}_i$, and/or to another end-user device (e.g., a siren) of the end-user equipment $\mathbf{10}_i$, to direct a speaker to emit a ring, a siren-like sound or any outer distinctive warning sound.

As yet a further possibility, in some embodiments, the notification concerning the fire at the end-user premise $\mathbf{18}_j$ may comprise a simulated phone call at the VoIP phone $\mathbf{15}_i$ and/or the VoIP phone $\mathbf{16}_i$, which, upon being answered by someone at the end-user premise $\mathbf{18}_i$, plays an audible message concerning the fire at the end-user premise $\mathbf{18}_j$.

In this example, it is assumed that a party 71 is currently at the end-user premise $\mathbf{18}_i$ and observes one or more of the visual messages displayed by the computer $\mathbf{14}_i$, the VoIP phone $\mathbf{15}_i$, the VoIP phone $\mathbf{16}_i$, and the television unit $\mathbf{29}_i$ (and/or any audible message accompanying any of these visual messages, if applicable). The party 71 is thus notified of the fire at the end-user premise $\mathbf{18}_j$ and may take various actions depending on the circumstances, such as evacuate the end-user premise $18_i$, call emergency services, etc.

In some embodiments, the wireless communication link 95 may remain established between the communication apparatus $20_j$ and the communication apparatus 20; until the alarm system communication is terminated. Upon determining that the alarm system communication with the communication equipment 79 at the alarm monitoring central 73 is terminated, the processing entity 54 of the communication apparatus $20_j$ may cause the notification entity 68 of the communication apparatus $20_j$ to wirelessly transmit information to the communication apparatus $20_i$ via the wireless interface 70 of the communication apparatus $20_j$ in order to disestablish the wireless communication link 95.

In other embodiments, the wireless communication link 95 may remain established between the communication apparatus $20_j$ and the communication apparatus $20_i$ until the fire at the end-user premise $18_j$ is resolved. In other words, the wireless communication link 95 may remain established even after the termination of the alarm system communication (e.g., to allow the notification entity 68 of the communication apparatus $20_j$ to repeatedly transmit information such as the information 325 to instruct the end-user equipment $10_i$ to issue other notifications concerning the fire at the end-user premise $18_j$). When the wireless communication link 95 becomes unnecessary, for instance, because the fire has been resolved, it may be disestablished. To determine when the wireless communication link 95 may be disestablished, a command may be provided to the notification entity 68 of the communication apparatus $20_j$. For example, a user may input a command to disestablish the wireless communication link 95 via an end-user device (e.g., the VoIP phone $15_j$) connected to the communication apparatus $20_j$. The notification entity 68 of the communication apparatus $20_j$ may proceed to wirelessly transmit information to the communication apparatus $20_i$ via the wireless interface 70 of the communication apparatus $20_j$ in order to disestablish the wireless communication link 95.

While in the example presented above the processing entity 54 of the communication apparatus $20_j$ determines that a notification concerning the fire at the end-user premise $18_j$ is to be issued at another one of the end-user premises $18_1$-$18_N$ upon receiving the information indicative that the smoke detector of the alarm system $17_j$ detected smoke produced by the fire, in other examples, a more stringent condition may need to be met in order for the processing entity 54 to make such a determination. For instance, in some cases, the processing entity 54 may determine that a notification concerning the fire at the end-user premise $18_j$ is to be issued at another one of the end-user premises $18_1$-$18_N$ upon receiving information indicative that multiple smoke detectors of the alarm system $17_j$ detected smoke produced by the fire and/or that one or more smoke detectors of the alarm system $17_j$ have detected smoke produced by the fire for a threshold period of time (e.g., five (5) minutes), as this suggests that the fire is widespread and/or spreading. This can avoid unnecessary issuance of notifications at another one of the end-user premises $18_1$-$18_N$ for minor fires or accidental activations of a smoke detector of the alarm system $17_j$ (e.g., due to burnt food in an oven or microwave).

Also, while the example presented above involved a fire at the end-user premise $18_j$, similar operations may occur for other types of events that may occur at the end-user premise $18_j$ in order to issue notifications concerning such events at another one of the end-user premises $18_1$-$18_N$. Generally, any event at the end-user premise $18_j$ for which a notification is to be issued at another one of the end-user premises $18_1$-$18_N$ can be defined by various conditions.

For example, if an emergency phone call is placed to the emergency telephone number "911" using the VoIP phone $15_j$ or the POTS phone $16_j$ because a person at the end-user premise $18_j$ experiences an emergency (e.g., a medical emergency), the processing entity 54 of the communication apparatus $20_j$ determines that the called telephone number corresponds to the telephone number "911" included in the event information 47 in the database 66 and thus obtains an indication of the emergency at the end-user premise $18_j$. The notification entity 68 of the communication apparatus $20_j$ proceeds to establish a wireless communication link between the end-user equipment $10_j$ at the end-user premise $18_j$ and the end-user equipment $10_i$ at the end-user premise $18_i$ and transmits information to the end-user equipment $10_i$ via this wireless communication link to instruct the end-user equipment $10_i$ to issue a notification concerning the emergency at the end-user premise $18_j$ (e.g., a visual message and/or an audible message advising a party at the end-user premise $18_i$ that an emergency phone call has been placed by someone at the end-user premise $18_j$). Such a notification may allow a party at the end-user premise $18_i$ to go and help the person in need at the end-user premise $18_j$ until emergency personnel arrives on scene.

As another example, assume that the end-user premise $18_j$ is a house in which lives an individual under certain medication. Also assume for purposes of this example that the end-user equipment $10_j$ at the end-user premise $18_j$ comprises a detector monitoring a medicine cabinet at the end-user premise $18_j$ in which the individual keeps his/her medication whereby the detector detects every opening of the medicine cabinet. Assuming that the individual is required to take his/her medication three (3) times a day and that any additional medication during that day may have significant adverse effects on the individual's health, the communication apparatus $20_j$ may be configured to invoke the local notification mechanism contemplated herein if it receives information from the detector which indicates that the medicine cabinet was opened more than three (3) times in one day. In such cases, the notification entity 68 may proceed to establish a wireless communication link between the end-user equipment $10_j$ at the end-user premise $18_j$ and the end-user equipment $10_i$ at the end-user premise $18_i$ and transmit information to the end-user equipment $10_i$ via this wireless communication link to instruct the end-user equipment $10_i$ to issue a notification concerning the fact that the medicine cabinet at the end-user premise $18_j$ was opened a number of times which is of potential concern. Such a notification may allow a party at the end-user premise $18_i$ to go and check on the individual at the end-user premise $18_j$ to ensure that he/she is fine.

It will thus be appreciated that, in this embodiment, interaction between the communication apparatus $20_j$ at the end-user premise $18_j$ and the communication apparatus $20_i$ at the end-user premise $18_i$ provides a local notification mechanism enabling a notification concerning a particular event at the end-user premise $18_j$ to be issued at the end-user premise $18_i$.

The local notification mechanism contemplated herein may be implemented in various other ways in other embodiments.

For example, in some embodiments, one or more end-user devices of the end-user equipment $10_x$ at the end-user premise $18_x$ may have wireless capabilities that can be exploited to implement the local notification mechanism contemplated herein.

Figure 6A:
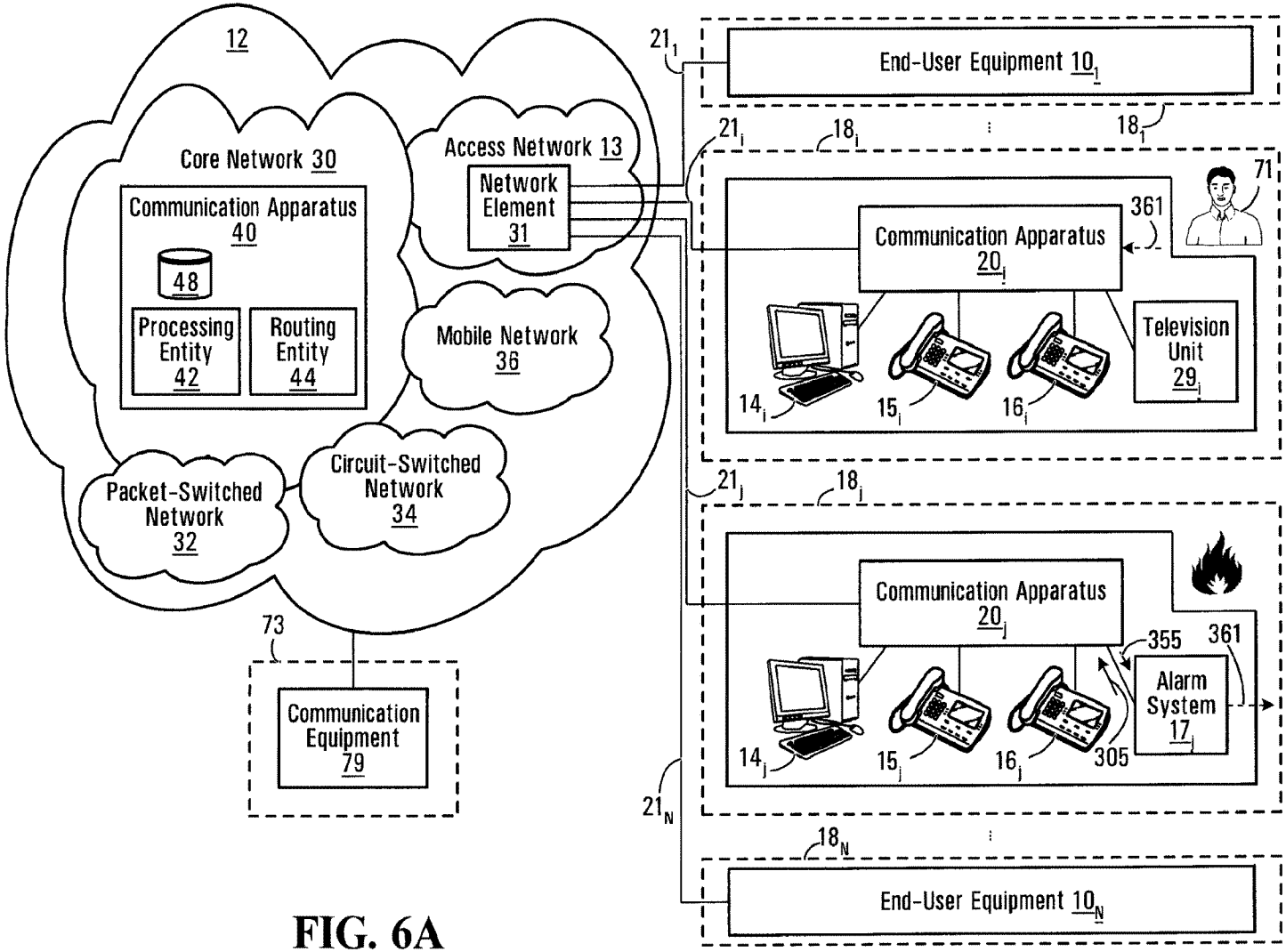
FIGS. 6A and 6B show a variant of the example considered in FIGS. 5A and 5B.

With reference to FIG. 6A, a variant to the example considered above will be discussed in which it is assumed that the alarm system $17_j$, which detected the fire at the end-user premise $18_j$, is a wireless alarm system. That is, in this example, each of one or more devices of the alarm system $17_j$ comprises a wireless interface comprising a wireless transmitter and a wireless receiver that can wirelessly exchange information with another device of the alarm system $17_j$ and/or the wireless interface 80 of the communication apparatus $20_j$. More particularly, in this example, it is assumed that each of the smoke detector and the controller of the alarm system $17_j$ comprises a wireless interface allowing them to wirelessly exchange information with one another and with any other wireless-enabled device within range.

As in the example considered above, upon the smoke detector of the alarm system $17_j$ detecting the smoke produced by the fire at the end-user premise $18_j$, the communication apparatus $20_j$ receives the information 305 from the alarm system $17_j$ pertaining to the alarm system communication effected by the alarm system $17_j$. Also, as in the example considered above, the processing entity 54 of the communication apparatus $20_j$ determines that the IP address "10.10.2.7" included in the information 305 corresponds to the IP address "10.10.2.7" included in the event information 47 in the database 66. Accordingly, like in the example considered above, since the IP address "10.10.2.7" identifies the smoke detector of the alarm system $17_j$, the processing entity 54 obtains an indication of the fire at the end-user premise $18_j$ and determines that a notification concerning this fire is to be issued at another one of the end-user premises $18_1$-$18_N$.

Thus, the communication apparatus $20_j$ attempts to cause issuance of a notification concerning the fire at the end-user premise $18_j$ at another one of the end-user premises $18_1$-$18_N$. More particularly, the communication apparatus $20_j$ attempts to establish a wireless communication link via which it can transmit information causing issuance of such a notification at another one of the end-user premises $18_1$-$18_N$.

The processing entity 54 of the communication apparatus $20_j$ accesses the database 66 of the communication apparatus $20_j$ to obtain the end-user equipment information 43 regarding end-user equipment at one or more other ones of the end-user premises $18_1$-$18_N$ that is within wireless range of the end-user equipment $10_j$ at the end-user premise $18_j$.

As in the example considered above, in this variant example, it is assumed that the end-user equipment information 43 in the database 66 of the communication apparatus $20_j$ includes an identifier of the communication apparatus $20_i$ (e.g., a MAC address, EHA, or other hardware identifier of the communication apparatus $20_i$, an IP address assigned to the communication apparatus $20_i$, a URI such as a SIP URI. or any other information that identifies the communication apparatus $20_i$) and access information to be provided to the communication apparatus $20_i$ in order to make use of the communication apparatus $20_i$ (e.g., a password or a wireless network key).

The processing entity 54 of the communication apparatus $20_j$ retrieves the identifier and access information of the communication apparatus $20_i$. In the embodiment considered above, the communication apparatus $20_j$ uses this identifier and access information to establish the wireless communication link 95 between itself and the communication apparatus $20_i$. In this variant, however, the communication apparatus $20_j$ attempts to establish a wireless communication link between the alarm system $17_j$ and the communication apparatus $20_i$ instead.

More particularly, the notification entity 68 of the communication apparatus $20_j$ transmits information 355 to the alarm system $17_j$. In this embodiment, the information 355 is transmitted to the controller of the alarm system $17_j$. The information 355 includes the identifier and access information for the communication apparatus $20_i$ retrieved from the database 66 as well as an indication to establish a wireless communication link between itself, i.e., the alarm system $17_j$, and the communication apparatus $20_i$.

Upon receipt of the information 355, the controller of the alarm system $17_j$ wirelessly sends information 361 to the communication apparatus $20_i$ via its wireless interface. The information 361 includes the identifier and access information of the communication apparatus $20_i$ that was retrieved from the database 66 by the processing entity 54 of the communication apparatus $20_j$. In this example, the information 361 also includes an identifier of the controller of the alarm system $17_j$.

When it receives the information 361, the communication apparatus $20_i$ attempts to validate the identifier and access information of the communication apparatus $20_i$ that are included in the information 361. More particularly, the processing entity 54 of the communication apparatus $20_i$ verifies whether the identifier and access information of the communication apparatus $20_i$ that are included in the information 361 correspond to the identifier and access information of the communication apparatus $20_i$ that are included in the end-user equipment information 41 in the database 66 of the communication apparatus $20_i$. If not, the communication apparatus $20_i$ may deny to the request of the alarm system $17_j$ to access the communication apparatus $20_i$ and may take some other action. For instance, the communication apparatus $20_i$ may send information back to the alarm system $17_j$ indicating that access to the communication apparatus $20_i$ is denied, and/or may send information to the communication apparatus 40 of the core network 30 to indicate that a failed connection attempt has occurred due to invalid credentials.

Figure 6B:
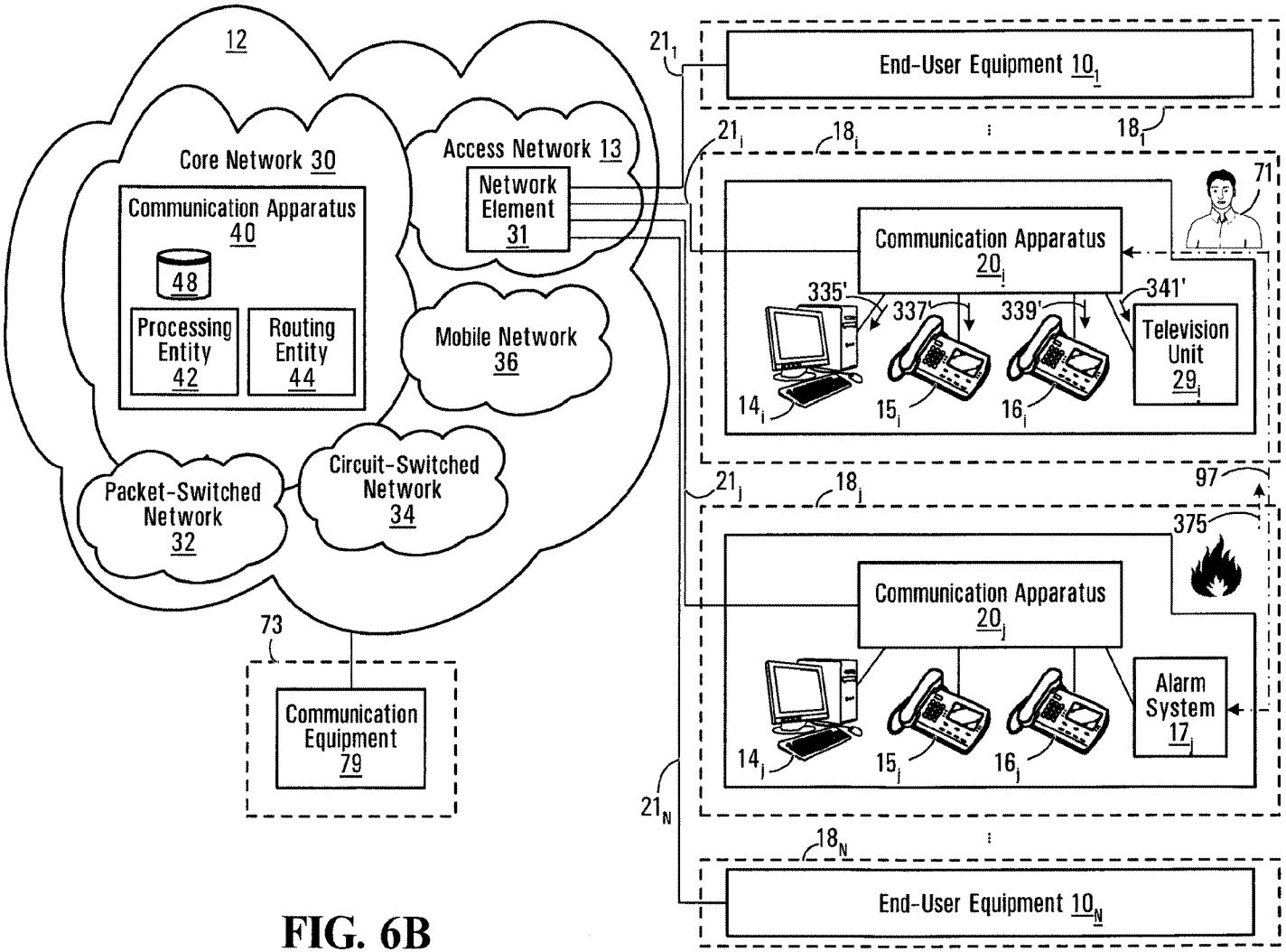

In this example, it is assumed that the identifier and access information of the communication apparatus $20_i$ that are included in the information 361 indeed correspond to the identifier and access information of the communication apparatus $20_i$ that are included in the end-user equipment information 41 in the database 66 of the communication apparatus $20_i$. Therefore, as shown in FIG. 6B, the communication apparatus $20_i$ grants access to the alarm system $17_j$, resulting in establishment of a wireless communications link 97 between the alarm system $17_j$ and the communication apparatus $20_i$. In other words, in this example, the alarm system $17_j$ wirelessly joins the local network at the end-user premise $18_i$.

With the wireless communication link 97 being established, the alarm system $17_j$ transmits information 375 to the communication apparatus $20_i$ via the wireless communication link 97. The information 375 instructs the end-user equipment $10_i$ at the end-user premise $18_i$ to issue a notification concerning the fire at the end-user premise $18_j$.

More particularly, in this embodiment, the information 375 comprises information indicative of the fire at the end-user premise $18_j$. Also, in this embodiment, the information 375 comprises the location information 53 indicative of the physical location of the end-user premise $18_j$ at which the fire occurs, which may be included in the information 361 upon being retrieved from the database 66 of the communication apparatus $20_j$. The information 375 may also comprise information advising a party at the end-user premise $18_i$ to evacuate this premise in view of the fire.

Upon receiving the information 375, the notification entity 68 of the communication apparatus $\mathbf{20}_i$ causes the end-user equipment $\mathbf{10}_i$ at the end-user premise $\mathbf{18}_i$ to issue a notification concerning the fire at the end-user premise $\mathbf{18}_j$. This notification can take on many forms in various embodiments.

For example, in some embodiments, the notification concerning the fire at the end-user premise $\mathbf{18}_j$ may comprise one or more visual messages displayed on one or more end-user devices of the end-user equipment $\mathbf{10}_i$. More particularly, in this example, the notification entity 68 of the communication apparatus $\mathbf{20}_i$ transmits information 335', 337', 339', 341' to the computer $\mathbf{14}_i$, the VoIP phone $\mathbf{15}_i$, the VoIP phone $\mathbf{16}_i$, and the television unit $\mathbf{29}_i$ via the connectors $\mathbf{52}_1$-$\mathbf{52}_M$ and/or the wireless interface 80 of the communication apparatus $\mathbf{20}_i$ to direct these end-user devices to display respective visual messages concerning the fire at the end-user premise $\mathbf{18}_j$. Upon receiving the information 335', 337', 339', 341', the computer $\mathbf{14}_i$, the VoIP phone $\mathbf{15}_i$, the VoIP phone $\mathbf{16}_i$, and the television unit $\mathbf{29}_i$, display respective visual messages concerning the fire at the end-user premise $\mathbf{18}_j$. These visual messages may have different content and/or formats, for instance, depending on display capabilities of the computer $\mathbf{14}_i$, the VoIP phone $\mathbf{15}_i$, the VoIP phone $\mathbf{16}_i$, and the television unit $\mathbf{29}_i$. For example, each message may be "Fire at neighbor's house! Evacuate immediately!" or any conceivable variant thereof.

Alternatively or additionally, in some embodiments, the notification concerning the fire at the end-user premise $\mathbf{18}_j$ may comprise one or more audible messages emitted by one or more end-user devices of the end-user equipment $\mathbf{10}_i$. For instance, in this example, the information 335', 337', 339', 341' transmitted to the computer $\mathbf{14}_i$, the VoIP phone $\mathbf{15}_i$, the VoIP phone $\mathbf{16}_i$, and the television unit $\mathbf{29}_i$ may also direct speakers of these end-user devices to emit audible messages accompanying the visual messages that they display.

As yet another possibility, in some embodiments, the notification concerning the fire at the end-user premise $\mathbf{18}_j$ may comprise an audible warning signal emitted by one or more end-user devices of the end-user equipment $\mathbf{10}_i$. For instance, in this example, the notification entity 68 of the communication apparatus $\mathbf{20}_i$ may transmit information to one or more of the computer $\mathbf{14}_i$, the VoIP phone $\mathbf{15}_i$ the VoIP phone $\mathbf{16}_i$, and the television unit $\mathbf{29}_i$, and/or to another end-user device (e.g., a siren) of the end-user equipment $\mathbf{10}_i$, to direct a speaker to emit a ring, a siren-like sound or any outer distinctive warning sound.

As yet a further possibility, in some embodiments, the notification concerning the fire at the end-user premise $\mathbf{18}_j$ may comprise a simulated phone call at the VoIP phone $\mathbf{15}_i$ and/or the VoIP phone $\mathbf{16}_i$, whereby upon being answered by someone at the end-user premise $\mathbf{18}_i$ plays an audible message concerning the fire at the end-user premise $\mathbf{18}_i$.

In this variant example, as in the example considered above, it is assumed that the party 71 at the end-user premise $\mathbf{18}_i$ observes one or more of the visual messages displayed by the computer $\mathbf{14}_i$, the VoIP phone $\mathbf{15}_i$, the VoIP phone $\mathbf{16}_i$, and the television unit $\mathbf{29}_i$ (and/or any audible message accompanying any of these visual messages, if applicable). The party 71 is thus notified of the fire at the end-user premise $\mathbf{18}_j$ and may take various actions depending on the circumstances, such as evacuate the end-user premise $\mathbf{18}_i$, call emergency services, etc.

While this embodiment illustrates one way in which the local notification mechanism contemplated herein may be implemented using wireless capabilities of one or more end-user devices of the end-user equipment $\mathbf{10}_x$ at the end-user premise $\mathbf{18}_x$, such wireless capabilities may be exploited in other ways in other embodiments to implement the failover mechanism.

For example, in some embodiments, upon obtaining an indication of a particular event at the end-user premise $\mathbf{18}_x$ for which a notification is to be issued at another one of the end-user premises $\mathbf{18}_1$-$\mathbf{18}_N$, the communication apparatus $\mathbf{20}_x$ at the end-user premise $\mathbf{18}_x$ may establish a wireless communication link with a wireless-enabled end-user device that is part of the end-user equipment $\mathbf{10}_y$ at the end-user premise $\mathbf{18}_y$ rather than with the communication apparatus $\mathbf{20}_y$ directly. For instance, in the example considered above, the communication apparatus $\mathbf{20}_j$ at the end-user premise $\mathbf{18}_j$ may establish one or more wireless communication link between itself and the computer $\mathbf{14}_i$, the VoIP phone $\mathbf{15}_i$, the VoIP phone $\mathbf{16}_i$, and/or the television unit $\mathbf{29}_i$ (using an identifier and possibly access information for each of these end-user devices retrieved from the database 66 of the communication apparatus $\mathbf{20}_j$) and transmit information to the computer $\mathbf{14}_i$, the VoIP phone $\mathbf{15}_i$, the VoIP phone $\mathbf{16}_i$, and/or the television unit $\mathbf{29}_i$ via these one or more wireless communication links in order to instruct any of these end-user devices to present a visual message (possibly accompanied by an audible message) concerning the fire at the end-user premise $\mathbf{18}_j$.

As another example, in some embodiments, upon obtaining an indication of a particular event at the end-user premise $\mathbf{18}_x$ for which a notification is to be issued at another one of the end-user premises $\mathbf{18}_1$-$\mathbf{18}_N$, the communication apparatus $\mathbf{20}_x$ at the end-user premise $\mathbf{18}_x$ may establish a wireless communication link between a wireless-enabled end-user device that is part of the end-user equipment $\mathbf{10}_x$ and a wireless-enabled end-user device that is part of the end-user equipment $\mathbf{10}_y$ at the end-user premise $\mathbf{18}_y$. For instance, in the example considered above, the communication apparatus $\mathbf{20}_j$ at the end-user premise $\mathbf{18}_j$ may establish one or more wireless communication link between the alarm system $\mathbf{17}_j$ and the computer $\mathbf{14}_i$, the VoIP phone $\mathbf{15}_i$, the VoIP phone $\mathbf{16}_i$, and/or the television unit $\mathbf{29}_i$ (using an identifier and possibly access information for each of these end-user devices retrieved from the database 66 of the communication apparatus $\mathbf{20}_j$) and cause the alarm system $\mathbf{17}_j$ to transmit information to the computer $\mathbf{14}_i$, the VoIP phone $\mathbf{15}_i$, the VoIP phone $\mathbf{16}_i$, and/or the television unit $\mathbf{29}_i$, via these one or more wireless communication links in order to instruct any of these end-user devices to present a visual message (possibly accompanied by an audible message) concerning the fire at the end-user premise $\mathbf{18}_j$.

The embodiments considered above illustrate that, in some cases, it is useful or necessary to know the physical location of the end-user premise $\mathbf{18}_x$ at which a particular event occurs. Although in the embodiments considered above, the physical location of the end-user premise $\mathbf{18}_x$ at which a particular event occurs is derived from the location information 53 included in the database 66 of the communication apparatus $\mathbf{20}_x$ at the end-user premise $\mathbf{18}_x$, this physical location may be derived in various other ways in other embodiments.

For example, in some embodiments, the physical location of the end-user premise $\mathbf{18}_x$ at which a particular event occurs may be determined using the location information 23 included in the database 48 of the communication apparatus 40 of the core network 30. In such embodiments, upon receiving an identifier of a piece of equipment at the end-user premise $\mathbf{18}_x$ at which a particular event occurs (e.g., in the example considered above, the identifier of the communication apparatus $\mathbf{20}_j$ which may be included in the information 325, 375 transmitted by the end-user equipment $\mathbf{10}_j$), the communication apparatus $\mathbf{20}_y$ at the end-user premise $\mathbf{18}_y$ may obtain the location information 23 indicating the physical location of the end-user premise $\mathbf{18}_x$ by communicating with the communication apparatus 40 via the communication link $\mathbf{21}_y$. Once obtained, the location information 23 indicating the physical location of the end-user premise $\mathbf{18}_x$ may be used by the communication apparatus $\mathbf{20}_y$ at the end-user premise $\mathbf{18}_y$ to know the physical location of the end-user premise $\mathbf{18}_x$ at which the particular event occurs.

As another example, in some embodiments, the physical location of the end-user premise $\mathbf{18}_x$ at which a particular event occurs may be determined using triangulation techniques (e.g., multilateration or trilateration). For instance, location algorithms may determine the physical location of the end-user premise $\mathbf{18}_x$ based on three or more times of arrival of a signal wirelessly transmitted by a piece of equipment of the end-user equipment $\mathbf{10}_x$ (e.g., the communication apparatus $\mathbf{20}_x$) at three (3) or more wireless receivers having known locations that are distributed among the end-user equipment $\mathbf{10}_1$-$\mathbf{10}_N$ at the end-user premises $\mathbf{18}_1$-$\mathbf{18}_N$ and/or equipment at various other places. Such triangulation techniques, which can be based on times of arrival either explicitly (i.e., on the times of arrival themselves) or implicitly (i.e., on differences between the times of arrival), are well known and need not be described here. An example of a system enabling such location capabilities is the Wi-Fi Positioning System (WPS) provided by Skyhook Wireless Inc. and described at http://www.skyhookwireless.com/, which is hereby incorporated by reference herein.

Thus, using triangulation techniques, a "location" database including location information indicating the physical locations of the end-user equipment $\mathbf{10}_1$-$\mathbf{10}_N$ at the end-user premises $\mathbf{18}_1$-$\mathbf{18}_N$ (and possibly equipment at various other places) can be created and maintained by the service provider serving the end-user premises $\mathbf{18}_1$-$\mathbf{18}_N$ or by another party. The location database may associate the location information indicating the physical location of the end-user equipment $\mathbf{10}_x$ to an identifier of a piece of equipment of the end-user equipment $\mathbf{10}_x$ (e.g., the identifier of the communication apparatus $\mathbf{20}_x$). In such embodiments, upon receiving an identifier of a piece of equipment of the end-user premise $\mathbf{18}_x$ at which a particular event occurs (e.g., in the example considered above, the identifier of the communication apparatus $\mathbf{20}_j$ which may be included in the information 325, 375 transmitted by the end-user equipment $\mathbf{10}_j$), the communication apparatus $\mathbf{20}_y$ at the end-user premise $\mathbf{18}_y$ may obtain the location information indicating the physical location of the end-user premise $\mathbf{18}_x$ from the location database by communicating with equipment of the service provider or other party managing the location database via the communication link $\mathbf{21}_y$. Once obtained, the location information indicating the physical location of the end-user premise $\mathbf{18}_x$ may be used by the communication apparatus $\mathbf{20}_y$ at the end-user premise $\mathbf{18}_y$ to know the physical location of the end-user premise $\mathbf{18}_x$ at which the particular event occurs.

In the embodiments considered above, the processing entity 54 of the communication apparatus $\mathbf{20}_x$ can obtain an indication of a particular event at the end-user premise $\mathbf{18}_x$ and determine that a notification concerning this event is to be issued at another one of the end-user premises $\mathbf{18}_1$-$\mathbf{18}_N$ by determining that an identifier (e.g., a telephone number, an IP address, a URI such as a SIP URI, a MAC address, EHA or other hardware identifier, etc.) included in information received at the communication apparatus $\mathbf{20}_x$ in relation to the particular event (e.g., the information 305 in the examples considered above) corresponds to a predetermined identifier specified by the event information 47 in the database 66 of the communication apparatus $\mathbf{20}_x$. The processing entity 54 of the communication apparatus $\mathbf{20}_x$ may obtain an indication of a particular event at the end-user premise $\mathbf{18}_x$ and determine that a notification concerning this event is to be issued at another one of the end-user premises $\mathbf{18}_1$-$\mathbf{18}_N$ in various other ways in other embodiments based on information received in relation to the particular event.

For example, in some embodiments, the processing entity 54 of the communication apparatus $\mathbf{20}_x$ can obtain an indication of a particular event at the end-user premise $\mathbf{18}_x$ and determine that a notification concerning this event is to be issued at another one of the end-user premises $\mathbf{18}_1$-$\mathbf{18}_N$ by determining that an identifier included in information received at the communication apparatus $\mathbf{20}_x$ in relation to the particular event (e.g., the information 305 in the examples considered above) corresponds to a predetermined identifier specified by a processing logic implemented by the processing entity 54. For instance, the processing logic implemented by the processing entity 54 may include one or more conditional statements checking whether an identifier included in received information corresponds to a predetermined identifier (e.g., "if IP address "10.10.2.7" included in received information, then conclude there is a fire at premise and effect issuance of notification concerning fire"; "if telephone number "911" included in received information, then conclude there is an emergency at premise and effect issuance of notification concerning emergency"; etc.).

As another example, in some embodiments, information received at the communication apparatus $\mathbf{20}_x$ may specify an occurrence of a particular event at the end-user premise $\mathbf{18}_x$. For instance, such information may comprise a code having an assigned meaning which, when received by the processing entity 54 of the communication apparatus $\mathbf{20}_x$, results in the processing entity 54 obtaining an indication of the particular event and determining that a notification concerning this event is to be issued at another one of the end-user premises $\mathbf{18}_1$-$\mathbf{18}_N$. Considering as an illustration the examples considered above, the information 305 transmitted by the alarm system $\mathbf{17}_j$ may comprise a code specifying that the fire at the end-user premise $\mathbf{18}_j$ has been detected. Upon receiving this code, the processing entity 54 of the communication apparatus $\mathbf{20}_j$ obtains an indication of the fire at the end-user premise $\mathbf{18}_j$ and determines that a notification concerning this fire is to be issued at another one of the end-user premises $\mathbf{18}_1$-$\mathbf{18}_N$.

As yet another example, in some embodiments, the reception of certain information at the communication apparatus $\mathbf{20}_x$ may in itself (without consideration of the content of this information) result in the processing entity 54 of the communication apparatus $\mathbf{20}_x$ obtaining an indication of a particular event at the end-user premise $\mathbf{18}_x$ and determining that a notification concerning this event is to be issued at another one of the end-user premises $\mathbf{18}_1$-$\mathbf{18}_N$. For instance, an end-user device connected to a given one of the connectors $\mathbf{52}_1$-$\mathbf{52}_M$ of the communication apparatus $\mathbf{20}_x$ may be associated with a certain type of event that may occur at the end-user premise $\mathbf{18}_x$ such that reception of information at that given connector may constitute an indication of such an event at the end-user premise $\mathbf{18}_x$. Considering as an illustration a variant to the examples considered above, in some embodiments, instead of being connected to the communication apparatus $\mathbf{20}_j$, the controller of the alarm system $\mathbf{17}_j$ may be part of the communication apparatus $\mathbf{20}_j$ (e.g., be implemented by the processing entity 54) while one or more other alarm system devices of the alarm system $17_j$ may be connected to the communication apparatus $20_j$ via one or more of its connectors $52_1$-$52_M$ and/or its wireless interface 80. In such embodiments, assuming that the smoke detector which detected the smoke produced by the fire is connected to a given one of the connectors $52_1$-$52_M$, the reception at that given connector of information transmitted by the smoke detector upon detecting the smoke results in the processing entity 54 of the communication apparatus $20_j$ obtaining an indication of the fire at the end-user premise $18_j$ and determining that a notification concerning this fire is to be issued at another one of the end-user premises $18_1$-$18_N$.

In the embodiments considered above, the communication apparatus $20_x$ at the end-user premise $18_x$ can obtain an indication of a particular event at the end-user premise $18_x$ and establish a wireless communication link with the end-user equipment $10_y$ at the end-user premise $18_y$ in order to transmit information to the end-user equipment $10_y$ for causing the end-user equipment $10_y$ to issue a notification concerning this event. In other embodiments, such functions may be implemented by other pieces of equipment of the end-user equipment $10_x$ at the end-user premise $18_x$.

For example, in some embodiments, a given end-user device (e.g., a phone, computer, or alarm system device) at the end-user premise $18_x$ may itself obtain an indication of a particular event at the end-user premise $18_x$ and establish a wireless communication link with the end-user equipment $10_y$ at the end-user premise $18_y$ in order to transmit information to the end-user equipment $10_y$ for causing the end-user equipment $10_y$ to issue a notification concerning this event. In such embodiments, the given end-user device constitutes an apparatus implementing a processing entity and a notification entity operating in a manner similar to the processing entity 54 and the notification entity 68 of the communication apparatus $20_x$ in connection with the local notification mechanism contemplated herein. For instance, in a variant to the example considered above, the controller or the smoke detector of the wireless alarm system $17_j$ may obtain an indication of the fire at the end-user premise $18_j$ upon detection of the smoke by the smoke detector and may proceed to establish a wireless communication link (such as the wireless communication link 97) with the communication apparatus $20_i$ at the end-user premise $18_i$. In such a variant, the controller or the smoke detector of the wireless alarm system $17_j$ may store the identifier and access information of the communication apparatus $20_i$ in memory or request them from the database 66 of the communication apparatus $20_j$ and may use this information to establish the wireless communication link in a manner similar to that described above. Upon establishment of the wireless communication link, the controller or the smoke detector of the wireless alarm system $17_j$ may proceed to transmit information to the communication apparatus $20_i$ via the wireless communication link to instruct the end-user equipment $10_i$ to issue a notification concerning the fire at the end-user premise $18_j$.

In some embodiments, the end-user equipment $10_x$ at the end-user premise $18_x$ may use a private network address space for one or more end-user devices of the end-user equipment $10_x$, while the communication apparatus $20_x$ may communicate via the communication link $21_x$ using a public network address space. For example, the communication apparatus $20_x$ may be assigned a public IP address by the communications network 12 (e.g., by the communication apparatus 40 of the core network 30) and the one or more end-user devices of the end-user equipment $10_x$ may be assigned private IP addresses by the communication apparatus $20_x$. In such embodiments, the routing entity 62 of the communication apparatus $20_x$ performs a network address translation (NAT) process on data packets passing therethrough to translate their addresses from the private network address space to the public network address space, and vice versa.

When the local notification mechanism contemplated herein is invoked in these embodiments, in cases where a wireless communication link is established between the communication apparatus $20_x$ at the end-user premise $18_x$ and the communication apparatus $20_y$ at the end-user premise $18_y$, the NAT process performed by the communication apparatus $20_x$ and, if applicable, the NAT process performed by the communication apparatus $20_y$ can take into account the establishment of the wireless communication link in order to avoid potential private network address clashes.

For example, considering the previous example discussed in connection with FIGS. 5A and 5B where the wireless communication link 95 is established between the communication apparatus $20_j$ at the end-user premise $18_j$ and the communication apparatus $20_i$ at the end-user premise $18_i$, it is assumed that (prior to the wireless communication link 95 being established) the computer $14_j$, the VoIP phone $15_j$, an ATA associated with the POTS phone $16_j$, and the alarm system devices of the alarm system $17_j$ are assigned private IP addresses by the communication apparatus $20_j$ which is itself assigned a public IP address by the communications network 12, and that the computer $14_i$, the VoIP phone $15_i$, the VoIP phone $16_i$ and the television unit $29_i$ are assigned private IP addresses by the communication apparatus $20_i$ which is itself assigned a public IP address by the communications network 12. More particularly, for purposes of this example, assume that the public IP address assigned to the communication apparatus $20_j$ is "122.1.17.6" and the public IP address assigned to the communication apparatus $20_i$ is "122.28.5.18".

In establishment of the wireless communication link 95, the notification entity 68 of the communication apparatus $20_i$ assigns a private IP address to the communication apparatus $20_j$, say "10.50.50.3" for purposes of this example. In other words, the communication apparatus $20_j$ can be viewed as becoming part of the private network address space used by the end-user equipment $10_i$ at the end-user premise $18_i$.

The notification entity 68 of the communication apparatus $20_j$ takes note of the private IP address "10.50.50.3" assigned to it by the communication apparatus $20_i$ such that data packets transmitted to the communication apparatus $20_i$ via the wireless communication link 95 to convey the information 325 have the private IP address "10.50.50.3" as their source address.

When it receives the data packets transmitted by the communication apparatus $20_j$ which have the private IP address "10.50.50.3" as their source address, the routing entity 62 of the communication apparatus $20_i$ knows that these packets come from the communication apparatus $20_j$ at the end-user premise $18_j$. Therefore, potential private network address clashes can be avoided.

While the embodiment considered above illustrates one way in which NAT may be taken into account in implementing the local notification mechanism contemplated herein, NAT may be taken into account in various other ways in other embodiments. Also, in some embodiments, NAT may not be needed and/or may not be performed (e.g., in cases where an IPv6 addressing scheme is used).

In the embodiments considered above the end-user equipment $10_x$ at the end-user premise $18_x$ can cause the end-user equipment $10_y$ at the end-user premise $18_y$ to issue a notification concerning a particular event at the end-user premise $18_x$. In other embodiments, instead of this notification being issued only at the end-user premise $18_y$, a corresponding notification can be issued at one or more other ones of the end-user premises $18_1$-$18_N$.

For example, in some embodiments, the end-user equipment $10_x$ at the end-user premise $18_x$ may establish two (2) or more wireless communication links with the end-user equipment at two (2) or more other ones of the end-user premises $18_1$-$18_N$ that are within its wireless range and transmit information to that end-user equipment via these wireless communication links in order to instruct that end-user equipment to issue respective notifications of the particular event at these other end-user premises.

As another example, in some embodiments, upon issuance by the end-user equipment $10_y$ at the end-user premise $18_y$ of a notification concerning a particular event at the end-user premise $18_x$ further to receipt of information transmitted by the end-user equipment $10_x$ via a first wireless communication link established between the end-user equipment $10_x$ and the end-user equipment $10_y$, the end-user equipment $10_y$ at the end-user premise $18_y$ may establish a second wireless communication link between itself and the end-user equipment $10_z$ at the end-user premise $18_z$ (which is within wireless range of the end-user equipment $10_y$) and transmit information to the end-user equipment $10_z$ via this second wireless communication link in order to instruct the end-user equipment $10_z$ to issue a corresponding notification at the end-user premise $18_z$. This "daisy chaining" process can allow parties at various ones of the end-user premises $18_1$-$18_N$ to be notified of the particular event at the end-user premise $18_x$, even if they are not within wireless range of the end-user equipment $10_x$ at the end-user premise $18_x$.

Those skilled in the art will appreciate that, in some embodiments, certain functionality of a given element described herein (e.g., the communication apparatus 40, any piece of equipment of the end-user equipment $10_x$ such as the communication apparatus $20_x$) may be implemented as pre-programmed hardware or firmware components (e.g., application specific integrated circuits (ASICs), electrically erasable programmable read-only memories (EEPROMs), etc.) or other related components. In other embodiments, a given element described herein (e.g., the communication apparatus 40, any piece of equipment of the end-user equipment $10_x$ such as the communication apparatus $20_x$) may comprise a processor having access to a memory which stores program instructions for execution by the processor to implement certain functionality of that given element. The program instructions may be stored on data storage media that is fixed, tangible, and readable directly by the processor. The data storage media may store data optically (e.g., an optical disk such as a CD-ROM or a DVD), magnetically (e.g., a hard disk drive, a removable diskette), electrically (e.g., semiconductor memory, floating-gate transistor memory, etc.), and/or in various other ways. Alternatively, the program instructions may be stored remotely but transmittable to the given element via a modem or other interface device connected to a network over a transmission medium. The transmission medium may be either a tangible medium (e.g., optical or analog communications lines) or a medium implemented using wireless techniques (e.g., microwave, infrared or other wireless transmission schemes).

Although various embodiments of the invention have been described and illustrated, it will be apparent to those skilled in the art that numerous modifications and variations can be made without departing from the scope of the invention, which is defined in the appended claims.

The invention claimed is:

1. An apparatus for notifying a party of a particular event at a first end-user premise, said apparatus comprising:

a processing entity configured to:

obtain an indication of the particular event; and use a selection process to select a second end-user premise within a wireless range of the first end-user premise, the selection process selecting the second end-user premise in response to receiving the indication of the particular event based on one or more dynamic variables associated with the second end-user premise; and a notification entity configured to:

establish a wireless communication link between end-user equipment at the first end-user premise and end-user equipment at the selected second end-user premise; and cause the end-user equipment at the first end-user premise to transmit information to the end-user equipment at the second end-user premise via the wireless communication link to direct the end-user equipment at the second end-user premise to issue a notification concerning the particular event.

2. Apparatus as claimed in claim 1, said apparatus being part of the end-user equipment at the first end-user premise and being connected to at least one end-user device at the first end-user premise, wherein, to establish the wireless communication link, said notification entity is configured to said establish the wireless communication link between said apparatus at the first end-user premise and the end-user equipment at the second end-user premise.

3. Apparatus as claimed in claim 1, said apparatus being part of the end-user equipment at the first end-user premise and being connected to at least one end-user device at the first end-user premise, wherein, to establish the wireless communication link, said notification entity is configured to establish the wireless communication link between a given end-user device of the at least one end-user device at the first end-user premise and the end-user equipment at the second end-user premise.

4. Apparatus as claimed in claim 1, wherein, to establish the wireless communication link, said notification entity is configured to cause the end-user equipment at the first end-user premise to wirelessly transmit certain information to the end-user equipment at the second end-user premise to establish the wireless communication link.

5. Apparatus as claimed in claim 4, the certain information comprising an identifier of a piece of equipment of the end-user equipment at the second end-user premise.

6. Apparatus as claimed in claim 5, the identifier of the piece of equipment of the end-user equipment at the second end-user premise comprising at least one of a hardware identifier and an Internet Protocol (IP) address.

7. Apparatus as claimed in claim 6, the hardware identifier comprising at least one of a Media Access Control (MAC) address and an Ethernet hardware address.

8. Apparatus as claimed in claim 5, the certain information comprising access information for the piece of equipment of the end-user equipment at the second end-user premise, the access information comprising at least one of a password and a wireless network key.

9. Apparatus as claimed in claim 1, said apparatus being part of the end-user equipment at the first end-user premise and being connected to at least one end-user device at the first end-user premise.

10. Apparatus as claimed in claim 9, comprising a wireless interface, wherein, to establish the wireless communication link, said notification entity is configured to cause said wireless interface to wirelessly transmit certain information to the send-user equipment at the second end-user premise to establish the wireless communication link between said apparatus at the first end-user premise and the end-user equipment at the second end-user premise.

11. Apparatus as claimed in claim 9, wherein, to establish the wireless communication link, said notification entity is configured to cause a given end-user device of the at least one end-user device at the first end-user premise to wirelessly transmit certain information to the end-user equipment at the second end-user premise to establish the wireless communication link between the given end-user device at the first end-user premise and the end-user equipment at the second end-user premise.

12. Apparatus as claimed in claim 1, wherein, to obtain the indication of the particular event, said processing entity is configured to receive certain information associated with occurrence of the particular event.

13. Apparatus as claimed in claim 12, the certain information comprising an identifier of a given piece of equipment of the end-user equipment at the first end-user premise used in relation to the particular event, wherein, to obtain the indication of the particular event, said processing entity is configured to determine that the identifier corresponds to a predetermined identifier.

14. Apparatus as claimed in claim 13, the identifier comprising at least one of an IP address, a Uniform Resource Identifier (URI), a telephone number, and a hardware identifier.

15. Apparatus as claimed in claim 14, the hardware identifier comprising at least one of a MAC address and an Ethernet hardware address.

16. Apparatus as claimed in claim 13, wherein, to determine that the identifier corresponds to a predetermined identifier, said processing entity is configured to access a database and conclude that the identifier corresponds to a given identifier specified in the database.

17. Apparatus as claimed in claim 12, the certain information specifying the occurrence of the particular event.

18. Apparatus as claimed in claim 1, the notification comprising a visual message displayed by an end-user device of the end-user equipment at the second end-user premise.

19. Apparatus as claimed in claim 18, the end-user device of the end-user equipment at the second end-user premise being a telephone, a computer or a television unit.

20. Apparatus as claimed in claim 18, the visual message specifying the particular event at the first end-user premise.

21. Apparatus as claimed in claim 18, the visual message specifying an action to be performed by the party in relation to the particular event at the first end-user premise.

22. Apparatus as claimed in claim 1, the notification comprising an audible message emitted by an end-user equipment of the at least one end-user device at the second end-user premise.

23. Apparatus as claimed in claim 22, the end-user equipment of the end-user device at the second end-user premise being a telephone, a computer or a television unit.

24. Apparatus as claimed in claim 22, the audible message specifying the particular event at the first end-user premise.

25. Apparatus as claimed in claim 22, the audible message specifying an action to be performed by the party in relation to the particular event at the first end-user premise.

26. Apparatus as claimed in claim 1, the end-user equipment at the second end-user premise comprising a plurality of end-user devices, the notification comprising a plurality of messages presented by the end-user devices at the second end-user premise.

27. Apparatus as claimed in claim 26, the plurality of end-user devices comprising at least one of a telephone, a computer and a television unit.

28. Apparatus as claimed in claim 1, the notification comprising an audible warning signal emitted by an end-user device of the end-user equipment at the second end-user premise.

29. Apparatus as claimed in claim 1, the notification indicating a physical location of the first end-user premise.

30. Apparatus as claimed in claim 29, the information transmitted to the end-user equipment at the second end-user equipment via the wireless communication link allowing the end-user equipment at the second end-user premise to identify the physical location of the first end-user premise.

31. Apparatus as claimed in claim 30, the information transmitted to the end-user equipment at the second end-user premise via the wireless communication link comprising location information indicative of the physical location of the first end-user premise.

32. Apparatus as claimed in claim 30, the information transmitted to the end-user equipment at the second end-user premise via the wireless communication link comprising an identifier of the end-user equipment at the first end-user premise, the identifier being associated in a database with location information indicative of the physical location of the first end-user premise.

33. Apparatus as claimed in claim 1, the wireless communication link being a first wireless communication link, the notification being a first notification, said notification entity being configured to:

establish a second wireless communication link between the end-user equipment at the first end-user premise and end-user equipment at a third end-user premise; and cause the end-user equipment at the first end-user premise to transmit information to the end-user equipment at the third end-user premise via the second wireless communication link to direct the end-user equipment at the third end-user premise to issue a second notification concerning the particular event.

34. Apparatus as claimed in claim 1, the wireless communication link being a first wireless communication link, the notification being a first notification, the information transmitted to the end-user equipment at the second end-user premise via the first wireless communication link causing the end-user equipment at the second end-user premise to:

establish a second wireless communication link between the end-user equipment at the second end-user premise and a end-user equipment at a third end-user premise; and cause the end-user equipment at the second end-user premise to transmit information to the end-user equipment at the third end-user premise via the second wireless communication link to direct the end-user equipment at the third end-user premise to issue a second notification concerning the particular event.

35. An apparatus for notifying a party of a particular event at a first end-user premise, the party being located at a second end-user premise, said apparatus being located at the first end-user premise and being connected to a communications network via a first communication link, said apparatus controlling data routing within a first local network at the first end-user premise, the second end-user premise including a communication apparatus connected to the communications network via a second communication link, the communication apparatus controlling data routing within a second local network at the second end-user premise, said apparatus comprising:

a processing entity configured to:

obtain an indication of the particular event based on information transmitted by an end-user device within the first local network; and select the party for notification of the particular event using a selection process to select the second end-user premise within a wireless range of the first end-user premise based on one or more dynamic variables associated with the second end-user premise; and a notification entity configured to:

cause said apparatus to wirelessly join the second local network to establish a wireless communication link between said apparatus and the communication apparatus; and transmit information to the communication apparatus via the wireless communication link such that, upon receiving the information transmitted via the wireless communication link, the communication apparatus directs at least one end-user device within the second local network to issue a notification concerning the particular event.

36. Apparatus as claimed in claim 35, wherein, to cause said apparatus to wirelessly join the second local network, said notification entity is configured to wirelessly transmit access information to the second communication apparatus, the access information comprising at least one of a password and a wireless network key.

37. Apparatus as claimed in claim 35, wherein, to cause said apparatus to wirelessly join the second local network, said notification entity is configured to cause said apparatus to be assigned an Internet Protocol (IP) address by the second communication apparatus.

38. An apparatus for notifying a party of a particular event at a first end-user premise, the first end-user premise including first end-user equipment connected to a communications network via a first communication link, said apparatus comprising:

a processing entity configured to:

obtain an indication of the particular event; and use a selection process to select a second end-user premise within a wireless range of the first end-user premise, the selection process selecting the second end-user premise in response to receiving the indication of the particular event based on one or more dynamic variables associated with the second end-user premise; and a notification entity configured to:

establish a wireless communication link between the first end-user equipment and second end-user equipment at the selected second end-user premise, the second end-user equipment being connected to the communications network via a second communication link; and cause the first end-user equipment to transmit information to the second end-user equipment via the wireless communication link to instruct the second end-user equipment to issue a notification concerning the particular event.

39. Apparatus as claimed in claim 38, the first end-user premise being associated with a first subscription to communication services provided by a service provider using the first communication link, the second end-user premise being associated with a second subscription to communication services provided by the service provider using the second communication link.

40. The apparatus as claimed in claim 1, said apparatus being part of the end-user equipment at the first end-user premise and being connected to a plurality of end-user devices over a local network of the first end-user premise, the end-user equipment at the second end-user premise comprising a communication apparatus connected to a plurality of end-user devices over a local network of the second end-user premise, the wireless communication link being established between said apparatus and the communication apparatus of the second end-user premise.

41. Apparatus as claimed in claim 1, said establishing comprising causing the end-user equipment at the first end-user premise to be assigned an Internet Protocol (IP) address by the end-user equipment at the second end-user premise.

42. The apparatus as claimed in claim 1, wherein the selection process comprises evaluating a plurality of possible second end-user premises and selecting the second end-user premise based on one or more of a wireless signal strength and reported network traffic load of respective of the plurality of possible second end-user premises.

43. The apparatus as claimed in claim 35, wherein the selection process comprises evaluating a plurality of possible second end-user premises and selecting the second end-user premise based on one or more of a wireless signal strength and reported network traffic load of respective of the plurality of possible second end-user premises.

44. The apparatus as claimed in claim 38, wherein the selection process comprises evaluating a plurality of possible second end-user premises and selecting the second end-user premise based on one or more of a wireless signal strength and reported network traffic load of respective of the plurality of possible second end-user premises.

* * * * *